US011187055B2

(12) United States Patent
Løvoll et al.

(10) Patent No.: US 11,187,055 B2
(45) Date of Patent: Nov. 30, 2021

(54) PARTICULAR RELATING TO SUBSEA WELL CONSTRUCTION

(71) Applicant: New Subsea Technology AS, Stavanger (NO)

(72) Inventors: Thor Andre Løvoll, Stavanger (NO); Bjørn Krossnes Schmidt, Stavanger (NO); Sigbjørn Madsen, Bru (NO)

(73) Assignee: New Subsea Technology AS, Stavanger (NO)

( * ) Notice: Subject to any disclaimer, the term of this patent is extended or adjusted under 35 U.S.C. 154(b) by 0 days.

(21) Appl. No.: 16/483,669

(22) PCT Filed: Feb. 6, 2018

(86) PCT No.: PCT/NO2018/050031

§ 371 (c)(1),
(2) Date: Aug. 5, 2019

(87) PCT Pub. No.: WO2018/143823

PCT Pub. Date: Aug. 9, 2018

(65) Prior Publication Data

US 2020/0018134 A1 Jan. 16, 2020

(30) Foreign Application Priority Data

Feb. 6, 2017 (NO) ..... 20170180
Oct. 13, 2017 (NO) ..... 20171629

(51) Int. Cl.
*E21B 33/076* (2006.01)
*E21B 33/038* (2006.01)
(Continued)

(52) U.S. Cl.
CPC ..... *E21B 33/076* (2013.01); *E21B 33/038* (2013.01); *E21B 34/04* (2013.01);
(Continued)

(58) Field of Classification Search
CPC .... E21B 33/076; E21B 33/038; E21B 33/043; E21B 33/14; E21B 34/04; E21B 41/08; E21B 47/07; E21B 47/06
See application file for complete search history.

(56) References Cited

U.S. PATENT DOCUMENTS 2,532,341 A * 12/1950 Shannon ..... E21B 33/037 166/96.1
3,063,500 A * 11/1962 Logan ..... E21B 33/037 166/351
(Continued)

FOREIGN PATENT DOCUMENTS

EP 1350003 10/2003
EP 2315907 5/2011
(Continued)

OTHER PUBLICATIONS

International Search Report and Written Opinion for PCT/NO2018/050031, dated Jun. 11, 2018.
(Continued)

*Primary Examiner* — Aaron L Lembo
(74) *Attorney, Agent, or Firm* — Andrus Intellectual Property Law, LLP

(57) ABSTRACT

A method is for constructing a subsea well and an associated unit. The method may include: providing a unit having at least one component of a flow control assembly, the flow control assembly to be operable for controlling a flow of injection or production fluid during operation of the well after the well has been constructed; lowering the unit through sea toward a seabed; receiving part of the unit in a subsurface of the seabed to anchor the unit in place, part of the unit projecting above the seabed, whereby the component of the flow control assembly is positioned in the
(Continued)

projecting part; and performing at least one well construction operation through a bore in the unit.

27 Claims, 11 Drawing Sheets

(51) Int. Cl.

| | |
|---|---|
| ***E21B 34/04*** | (2006.01) |
| ***E21B 41/08*** | (2006.01) |
| ***E21B 33/043*** | (2006.01) |
| ***E21B 33/14*** | (2006.01) |
| ***E21B 47/06*** | (2012.01) |
| ***E21B 47/07*** | (2012.01) |

(52) U.S. Cl.
CPC ..... *E21B 41/08* (2013.01); *E21B 33/043* (2013.01); *E21B 33/14* (2013.01); *E21B 47/06* (2013.01); *E21B 47/07* (2020.05)

(56) References Cited

U.S. PATENT DOCUMENTS

| | | | | |
|---|---|---|---|---|
| 3,247,672 | A * | 4/1966 | Johnson | E21B 33/037 405/210 |
| 3,353,364 | A * | 11/1967 | Blanding | E21B 43/36 405/189 |
| 3,656,549 | A * | 4/1972 | Holbert, Jr. | E21B 41/08 166/356 |
| 4,630,680 | A * | 12/1986 | Elkins | E21B 33/035 166/341 |
| 4,703,813 | A | 11/1987 | Sieler | |
| 4,830,541 | A * | 5/1989 | Shatto | E02D 23/16 166/368 |
| 5,050,680 | A * | 9/1991 | Diehl | E21B 43/0122 166/356 |
| 6,209,650 | B1 * | 4/2001 | Ingebrigtsen | E21B 43/0135 166/368 |
| 8,534,365 | B2 * | 9/2013 | Dighe | E21B 43/0122 166/364 |
| 8,613,323 | B2 * | 12/2013 | Garbett | E21B 33/038 166/368 |
| 9,316,066 | B2 * | 4/2016 | MacMillan | E21B 19/002 |
| 10,253,569 | B2 * | 4/2019 | Ellison | E21B 33/043 |
| 10,344,551 | B2 * | 7/2019 | Ellingsen | E21B 33/037 |
| 2003/0051878 | A1 | 3/2003 | DeBerry | |
| 2004/0231846 | A1 | 11/2004 | Griffith et al. | |
| 2009/0020285 | A1 | 1/2009 | Chase et al. | |
| 2010/0006301 | A1 | 1/2010 | Fenton | |
| 2011/0274493 | A1 * | 11/2011 | Cutts | E21B 43/0122 405/60 |
| 2013/0269948 | A1 | 10/2013 | Hoffman et al. | |
| 2016/0060992 | A1 | 3/2016 | Nguyen | |
| 2016/0060994 | A1 | 3/2016 | Liew | |
| 2016/0333641 | A1 | 11/2016 | Ellison | |
| 2017/0130547 | A1 * | 5/2017 | Bhatnagar | E21B 33/00 |
| 2019/0162038 | A1 * | 5/2019 | Rein | E21B 33/035 |

FOREIGN PATENT DOCUMENTS

| | | | | |
|---|---|---|---|---|
| GB | 2346630 | | 8/2000 | |
| GB | 2358204 | | 9/2002 | |
| WO | 00/47864 | | 8/2000 | |
| WO | WO-2011162616 | A1 * | 12/2011 | E21B 33/035 |
| WO | 2012/163784 | | 12/2012 | |
| WO | 2017079627 | | 5/2017 | |
| WO | 2017155415 | | 9/2017 | |
| WO | 2018009077 | | 1/2018 | |

OTHER PUBLICATIONS

Response to the Written Opinion for PCT/NO2018/050031, dated Dec. 6, 2018.
Written Opinion for PCT/NO2018/050031, dated Jan. 18, 2019.
Response to the Written Opinion for PCT/NO2018/050031, dated Mar. 18, 2019.
International Preliminary Report on Patentability for PCT/NO2018/050031, dated Apr. 24, 2019.
Office Action for Norwegian Patent Application No. 20170180, dated Nov. 25, 2019.
Search Report for Norwegian Patent Application No. 20170180, dated Nov. 25, 2019.
ROV Hot Stabs and Receptacles. Prof. Laughlin of Stanford University, California. Retrieved from the Internet on Jun. 24, 2020, at: http://large.stanford.edu/publications/coal/references/ocean/rovs/tools/docs/ and http://large.stanford.edu/aublications/coal/references/ocean/rovs/tools/docs/h 1 .pdf.
FES Subsea Hot Stab Assemblies, Retrieved from the Internet on Octobers, 2016, at: https://web.archive.org/web/201610051 11133/http://www.fessubsea.co.uk/products/fes-subseas-hot-stab-assemblies/).
Wikipedia entry for "Christmas tree (oil well)". Retrieved from the Internet on Jun. 26, 2020, at: https://web.archive.org/A'eb/20170204214202/https://en.wikipedia.org/wiki/Christmas_tree_(oil_well).
SS Series Subsea Wellhead Systems, Promotional material marketed by Dril-Quip, Inc. Copyright 2014. Retrieved from the Internet on Jun. 29, 2020, at: https://www.dril-quip.com/resources/catalogs/04.%20SS%20Series%20Subsea %20Wellhead%20Systems.pdf.
Mirage Machines Portable Performance Blog, dated Sep. 22, 2015. Retrieved from the Internet on Jun. 26, 2020, at: https://web.archive.org/web/20160420123919/https://blog.miragemachines.com/6-of-the-most-common-flange-types-used-in-the-oil-and-gas-industry.
ExxonMobile Floating Dilling School, 2002 Edition.
Various Definitions of "Drilling Spool". Retrieved from the Internet on Jun. 26, 2020, at: https://www.iadclexicon.org/drilling-spool/.

* cited by examiner

PARTICULAR RELATING TO SUBSEA WELL CONSTRUCTION

CROSS-REFERENCE TO RELATED APPLICATIONS

This application is the U.S. national stage application of International Application PCT/N02018/050031, filed Feb. 6, 2018, which international application was published on Aug. 9, 2018, as International Publication WO 2018/143823 in the English language. The International Application claims priority of Norwegian Patent Application Nos. 20170180, filed Feb. 6, 2017 and 20171629, filed Oct. 13, 2017. The international application and Norwegian applications are all incorporated herein by reference, in entirety.

FIELD

The present invention relates to subsea wells, and in particular, to the construction of subsea wells for their subsequent operation.

BACKGROUND

Using subsea systems is well known in the petroleum industry. With advancements in technology, it is becoming increasingly common to use such systems for exploring and developing and producing hydrocarbons from oil and/or gas fields. These subsea systems can replace systems that were previously typically placed on platforms, doing so in a reliable, safe and cost-efficient manner. Using subsea systems is particularly advantageous in deep waters and/or remote locations, but can also offer cost-efficient solutions elsewhere.

Conventionally, subsea well drilling and production systems consist of multiple mechanical components with specific design features with low level of integration and optimization both for manufacturing and installation. To install a conventional subsea drilling and production system, it is usually required to run multiple independent installation steps, where several independent components of the subsea system are installed individually throughout a well construction process. The systems are generally not optimized with respect to interfaces to allow for more efficient installation sequences and/or choices of installation methods.

When this text refers to a conventional subsea system, it refers to a typical subsea system known to a person skilled in the art of installing such systems.

A typical installation sequence for a conventional subsea system is as follows:

A foundation is installed. This is done by drilling a hole with a diameter of 36 inches, 60 to 80 meters deep, vertically from the seabed. A conductor with a diameter of 30 inches is run into the hole. The conductor has a length such that, when a first end of the conductor reaches the bottom of the hole, an opposite end extends approximately two meters above the seabed. The end portion extending above the seabed is arranged with a low-pressure wellhead housing. The low-pressure wellhead housing has typically been arranged to the conductor aboard the drilling rig or drilling vesssel which is required for this foundation installation. To finalize the foundation, the conductor is cemented in place.

The next step is to install a surface casing and a high-pressure wellhead housing. A hole with a diameter of 26 inches is drilled, extending further downwards from the existing hole. A surface casing with a diameter of 20 inches is run into the hole. The surface casing has a length such that when a first end of the surface casing reaches the bottom of the hole the opposite end extends somewhat above the conductor. The surface casing has been arranged with the high-pressure wellhead housing which interfaces against the low-pressure wellhead housing. The high-pressure wellhead housing is typically arranged with the surface casing aboard a drilling vessel or drilling rig used for this part of the installation sequence. Finally, the surface casing is cemented in place in the well.

Then, a blowout preventer (BOP) is mounted onto the high-pressure wellhead housing, and a riser is attached to the subsea system.

Several casings are then installed. First, a hole with a diameter of 17.5 inches is drilled, extending further from the existing hole. A first casing is run into the hole, the first casing having a diameter of 13.375 inches. The first casing is suspended from a first casing hanger in the high-pressure well-head housing. To complete the installation of the first casing, it is cemented in place.

A hole with a diameter of 12.25 inches is then drilled, extending further from the existing hole. A second casing, having a diameter of 9.625 inches, is run into the hole. The second casing is suspended from a second casing hanger in the high-pressure wellhead housing. Cementing is then performed to complete the installation of the second casing.

Finally, a hole with a diameter of 8.5 inches is drilled, extending from the existing hole. A lower completion is run into the hole, the lower completion being suspended from the lower part of the second casing. Then upper completion is performed.

To finalize the installation, the BOP is removed, and a production flow base and a Christmas tree is installed onto the high-pressure wellhead housing.

A problem with the conventional subsea system can be that it offers little flexibility. Details in the installation may vary, of course, such as the length of each size (diameter) of casing. However, whether the subsea system is to be used for a shallow well or a deep well, the components and the installation sequence are mainly the same.

The limitation of the conventional system is may arise partly due to that it is designed for the sequential installation procedure described. Typically, the low-pressure wellhead housing needs to be installed with the conductor. The high-pressure housing typically needs to be installed with the surface casing. The two wellhead housings may then need to be arranged with means to connect to each other, and be assembled together subsea as part of the installation procedure. Furthermore, later on in the installation process, the production flow base and the Christmas tree may need to be mounted on and connected to the high-pressure wellhead housing, and these components may too have to be arranged with means to connect to each other.

It is known to replace the conventional foundation of the system, the 60-80 meters long conductor, with a suction caisson. By doing so, it may be possible to perform the installation of the foundation using an anchor-handling vessel instead of a drilling rig. However, the system may still be less than ideal, over-dimensioned for shallow wells, and/or overly cumbersome to install.

SUMMARY

The invention has for its object to remedy or to reduce at least one of the drawbacks of the prior art, or at least provide a useful alternative to prior art.

The object is achieved through features, which are specified in the description below and in the claims that follow.

According to a first aspect of the invention there is provided a method of constructing a subsea well, the method comprising the steps of: providing a unit comprising at least one component of a flow control assembly, the flow control assembly to be operable for controlling a flow of injection or production fluid during operation of the well after the well has been constructed; lowering the unit through sea toward a seabed; receiving part of the unit in a subsurface of the seabed to anchor the unit in place, part of the unit projecting above the seabed, whereby said component of the flow control assembly is positioned in the projecting part; and performing at least one well construction operation through a bore in the unit.

The step of providing the unit may comprise assembling the unit and/or assembling parts to form the unit.

The unit may further comprise at least one suction anchor or suction caisson. The step of receiving part of the unit in the subsurface may comprise receiving the suction anchor or suction caisson in the subsurface below the seabed.

The unit may further comprises a tubular, and the step of receiving part of the unit in the subsurface below the seabed may comprise receiving the tubular in the subsurface below the seabed. The tubular may comprise conductor casing.

The step of assembling the parts to form the unit may comprise connecting a first tubular body and second tubular body end to end. A bore of the first tubular body may then be arranged end to end with a bore of the second tubular body. The bores of the first and second tubulars may together form the bore in the unit through which the construction operation may be performed.

The method may further comprise making up a flange to flange connection to connect the first and second tubular bodies, and/or their bores, together end to end.

The first tubular body may comprise a main body and the second tubular body may comprise a spool body and/or spool body extension, wherein the part of the unit received in the subsurface may include part of the spool body or the spool body extension. The spool body or spool body extension may in turn be connected to a suction caisson or suction anchor which in such case may also be received in the subsurface. The main body typically has an aperture in a wall of the body to provide communication with the flow line. The aperature may extend radially through the wall of a vertical bore portion in the main body through which the well construction operation may be performed. Injection or production fluid may be transmitted into or out of the wellbore, respectively, through the aperature and the flow line of the flow control assembly. The second tubular body may be connected to a suction caisson or anchor.

The method may further comprise assembling the parts to form a stack so as to provide a unit comprising the stack, wherein the bore through which the well construction operation is to be performed extends through the stack. The method may further comprise connecting a first tubular and a second tubular together to form end-to-end connected tubulars in the stack.

The unit may comprise a stack of the assembled parts and the bore through which the well construction operation is to be performed may extend through the stack. The method may further comprises connecting any one or more of the following parts together to form the stack: a tubular main body having an aperture in a wall of the body for transmitting injection or production fluid between a flow line of the flow control assembly and an inside of the main body; a wear bushing located inside the bore to line the bore; a part to be received in the subsurface of the seabed to anchor the unit in place; a tubular interface spool connectable between the main body and the part to be received in the subsurface; at least one isolation valve to selectively open or close the bore above the main body or above the aperature; and a mandrel to be positioned above the isolation valve for connecting a blow out preventer or a riser to an upper end of the mandrel.

The method may further comprise anchoring the unit in place by receiving part of the unit in the subsurface. The method may comprise anchoring the unit in place by securing the part of the unit received in the subsurface in place by applying suction and/or using cement or curable mass. The part received in the subsurface may comprise an anchor or member theror e.g. a suction anchor, or a suction caisson.

The unit may further comprise at least one casing or liner hanger and/or corresponding casing or liner hanger profile. The step of performing the well construction operation may comprise: running at least one casing or liner through the bore in the unit; and hanging the casing or liner tubing from the casing or liner hanger and/or corresponding casing or liner hanger profile.

The unit may further comprises at least one tubing hanger profile. The method may further comprise: running at least one tubing, e.g. production or injection tubing, through the bore in the unit; and hanging the tubing from the tubing hanger profile.

Performing the well construction operation may comprise running a drill string through the bore in the unit and drilling a section of a wellbore of the well using the drill string.

Performing the well construction operation may comprise running a section of casing or liner into the subsurface through the bore in the unit. The method may further comprise cementing the section of casing or liner by delivering cement or curable mass into the subsurface through the bore in the unit.

The unit may further comprise a tubular wear bushing which is removably inserted to line the bore in the unit, and the method may further comprise removing the wear bushing to allow the flow control assembly to be operated in the production phase of the constructed well.

The component of the flow control assembly may comprise at least one valve or part thereof.

The component of the flow control assembly may comprise a flow line section for transmitting production fluid away from a wellbore of the well.

According to a second aspect of the invention there is provided a unit for constructing and operating a subsea well, the unit comprising: at least one component of a flow control assembly, the flow control assembly to be operable for controlling a flow of injection or production fluid in a flow line during operation of the well after the well has been constructed; at least one part configured to be received in a subsurface of the seabed for anchoring the unit or apparatus in place; and a bore through which at least one well construction operation can be performed. Preferably, the unit is configured so that it can be lowered in a single package toward the seabed and anchored in place through receiving said part of the unit or apparatus in the subsurface.

The unit may further comprise a stack of assembled parts through which the bore of the unit may extend. The parts in the stack may include any one or more of: a tubular main body having an aperture in a wall of the body for transmitting injection or production fluid between a flow line of the flow control assembly and an inside of the main body; a part to be received in the subsurface of the seabed to anchor the unit in place; a tubular interface spool connectable between the main body and the part to be received in the subsurface; at least one isolation valve to selectively open or close the bore above the main body or above the aperature; and a mandrel to be positioned above the isolation valve for connecting a blow out preventer or a riser to an upper end of the connector mandrel.

The further body may comprise a blow out preventer. The unit may further comprise a wear bushing located inside the bore to line the bore.

The stack may comprise part of valve tree for the well. The part to be received in the subsurface may comprise a suction anchor, or other member or support.

According to a third aspect of the invention, there is provided a method of providing a unit to be deployed for constructing and operating a subsea well, the method comprising: prior to deployment, assembling parts together to form the unit, the unit comprising at least one component of a flow control assembly, the flow control assembly to be operable for controlling fluid flow during production of hydrocarbons from the well after the well has been constructed; a part configured to be received in a subsurface below the seabed; and a bore through which at least one well construction operation can be performed.

According to a fourth aspect of the invention, there is provided a unit obtained by performing the method of the second aspect.

According to a fifth aspect of the invention, there is provided a method of constructing a subsea well, the method comprising: running a section of casing into the subsurface through a bore in a subsea unit which comprises at least one component of a flow control assembly, the flow control assembly to be operable for controlling a flow of injection or production fluid in a flow line during operation of the well after the well has been constructed.

The method may further comprise running a drill string through the bore and drilling at least one section of a wellbore of the well using the drill string.

According to a sixth aspect of the invention, there is provided a method of operating a subsea well which has been constructed using the method of the first or fifth aspects, the method comprising the step of operating at least one valve in the flow control assembly to transmit production or injection fluid away from or into the wellbore through a flow line.

According to a seventh aspect of the invention, there is provided a unit for constructing and operating a subsea well, the unit comprising: at least one component of a flow control assembly, the flow control assembly to be operable for controlling a flow of injection or production fluid in a flow line during operation of the well after the well has been constructed; and a bore for running a section of casing into the subsurface therethrough to facilitate constructing the well.

According to a eighth aspect of the invention, there is provided an apparatus for performing at least one operation to construct a well subsea, the apparatus comprising a plurality of valves such that the apparatus forms a flow control assembly for controlling fluid flow during production of hydrocarbons from the well, the apparatus being arranged with a through bore configured for allowing drilling and installation of casings and casing hangers to be performed through the bore.

The term "through the bore" includes both partly through the bore and fully through the bore. Typically, drilling will involve running a drill bit through the bore of the apparatus and into a formation below the apparatus for drilling a hole in the formation. Installation of casing hangers will typically involve moving a casing hanger into the bore, leading partly through the bore to a casing hanger latching profile, and latching the casing hanger onto the latching profile.

The apparatus may constitute a subsea system having an integrated flow control assembly, and it may provide all of or some of the functionality of a conventional subsea system, and it may provide additional functionality not normally provided by a conventional subsea system.

The Christmas tree in a conventional subsea system covers several important functions, such as controlling fluid flow during production, providing barriers and monitoring fluid flow. The flow control assembly that the apparatus forms is to be understood, herein, as a replacement for a conventional subsea Christmas tree. The flow control assembly may cover all of or a selection of the main functions covered by a Christmas tree in a conventional system, such as control of flow during injection into the well, pressure relief and monitoring functions such as sand detection and measurements of pressure, temperature, velocity of flow and more. In addition, the flow control assembly that the apparatus forms, may provide functionality not offered by a conventional flow control assembly such as a Christmas tree. Note that a less complex arrangement, e.g. comprising two valves to form barriers against blowouts or other accidents during well development does not constitute what is referred to herein as a "flow control assembly".

The flow control assembly may comprise all of or a combination of a master valve, a wing valve, a crossover valve and a choke valve required to perform the functions offered by a Christmas tree in a conventional subsea system. It may further comprise other valves and other equipment, such as one or more sensors, one or more fittings, one or more spools and/or one or more flanges required to perform the fluid control function offered by a Christmas tree in a conventional subsea system.

One of the limiting features in terms of flexibility of a conventional subsea system is the bore in the Christmas tree of the conventional subsea system. The Christmas tree typically has a bore with a diameter of up to approximately 8 inches, which means the Christmas tree cannot be installed until the majority of the drilling of the well is completed. After the installation of the Christmas tree, the bore in the Christmas tree is typically used for well intervention and other well manipulation tasks, not for further drilling.

The apparatus may have at least the flow control functionality of a conventional Christmas tree, while having a bore of a diameter large enough to allow drilling and installation of casings to be performed through the bore. This can make the apparatus advantageous, as it can allow for a simpler and more cost-efficient subsea well construction procedure, as it may be assembled onshore and subsequently installed on a seabed in one operation prior to drilling.

The apparatus may comprise a casing hanger landing profile. Preferably, the apparatus may comprise two casing hanger landing profiles, but it may also comprise more than two casing hanger landing profiles. A casing hanger landing profile offers a landing profile from which a casing may be suspended. The apparatus may further comprise a tubing hanger latching profile. The tubing hanger latching profile is a latching profile from which a tubing may be suspended. Furthermore, the apparatus may comprise a seal assembly latching profile. The seal assembly latching profile is a latching profile to which a seal assembly may be latched. Having a combination of such profiles will allow for hanging and/or latching a combination of one or more casings, tubings and/or seal assemblies. Having such features comprised by the apparatus is beneficial, particularly during well construction, as it means no external parts have to be connected to the apparatus to provide such features.

The apparatus may further comprise connection means for connecting to a riser and/or a blowout preventer (BOP). Having such connection means may be advantageous as it may become necessary to connect a BOP and/or a riser to the apparatus during well construction and/or production.

The apparatus may further comprise a flow-line connector for connecting to a flow-line. The flow-line may typically be a line of tubing or casing through which fluid may flow. It is advantageous for the apparatus to comprise a flow-line connector for connecting to a flow-line, as it will provide a route for flow from the apparatus to an external receiver.

The apparatus may further comprise a suction caisson for forming a well foundation. Installing a suction caisson as foundation requires no drilling, meaning an anchor-handling vessel or other types of light construction vessels may be used instead of a drilling rig or drilling vessel. This is a great advantage, particularly when several wells are to be drilled in a field, as it allows for more efficient use of resources in a field development project: An anchor-handling vessel or other types of light construction vessels are significantly cheaper in use than a drilling rig or vessel, and the installation process of a suction caisson as well foundation is significantly simplified compared to that of establishing a conventional foundation comprising a conductor and a low-pressure wellhead housing. The apparatus, comprising a suction caisson, will not need a pre-installed foundation to which to attach. Instead, the apparatus can simply be installed through suction, and form its own foundation. The apparatus may use other forms of well foundations. It may use a conventional conductor foundation as a foundation, or it may use any other structure fit to act as a foundation.

Furthermore, the apparatus may comprise a full-bore isolation valve. The full-bore isolation valve may be used as a barrier, e.g. for periods when a well is to be temporarily abandoned, and may thus offer a very efficient alternative to setting a plug in a well, which is currently the conventional method of establishing a well barrier element. Setting a plug for temporary abandonment may typically take 12 hours, whereas closing a full-bore isolation valve takes very little time.

The apparatus may further comprise a protective structure, for protecting the apparatus against external forces, corrosion, pollution, or other unwanted effects. The seabed may be a harsh environment, and a protective structure may help preserve the integrity of the apparatus and increase its longevity. The protective structure may be assembled to the apparatus prior to installation subsea.

The apparatus may further comprise an ROV-receptacle. ROV is short for remotely operated vehicle. The ROV-receptacle may be for receiving a hose from an ROV, for injection or extraction of a fluid. Having an ROV-receptacle is advantageous as it allows an ROV to connect to and manipulate the apparatus or a well to which the apparatus belongs. The ROV receptacle may be a hot stab receptacle. A hot stab receptacle may be beneficial as it is designed for connecting or disconnecting under pressure while causing little to no spill.

Furthermore, the apparatus may comprise a bore protector and/or a wear bushing for preventing wear and/or blocking pollution from entering valves, profiles and/or latches during drilling or cementing. The bore protector may be placed in the bore of the apparatus prior to drilling, and removed after drilling. This may be done using a winch, or by use of any other means suitable for the purpose. It is highly advantageous to use a protective element such as a bore protector during drilling, to prevent mud, sand, rocks, cement and/or other unwanted objects from damaging the integrity of sensitive components of the system. The bore protector and/or the wear bushing may comprise an upper and a lower seal, for sealing a portion of the bore, for protection of sensitive equipment and/or for pressure testing to be performed in the sealed-off portion of the bore.

The apparatus may further comprise an interface spool for forming an interface between a main body of the apparatus and a well foundation. The foundation may be the suction caisson. The main function of the interface spool is to mate the main body with the foundation and to transfer structural loads onto the foundation. The interface spool may comprise an outlet for cement returns for routing cement onto a seabed for preventing cement returns from returning through the main body of the apparatus during cementation. Having an interface spool with such features decreases the risk of having cement returns pollute valves, latching profiles and other sensitive equipment in the apparatus. The interface spool solution thus eliminates potential problems related to performing a cementing operation through the apparatus. The interface spool may comprise a plurality of outlets for cement returns. It may comprise one, two, three, four, five, six, seven, eight, or more than eight outlets for cement returns.

The outlet for cement returns may be a pipe running from an annulus of a wellbore, through the foundation, to an opening towards a sea floor. The pipe may comprise a valve for blocking the outlet, for creating a barrier between the sea and the annulus. The pipe may comprise a plurality of valves for creating a plurality of barriers.

The interface spool may further comprise a casing latching system for latching a casing in place after installing the casing in a wellbore. This is advantageous as it prevents upward movement of a casing string.

The interface spool may comprise an interface spool extension. The interface spool extension may be a pipe having a first end arranged to a lower end of the interface spool. The pipe may extend from the lower end of the interface spool to a bottom end of a foundation, such as a suction caisson, and may be arranged via structural support to an exterior portion of the foundation.

The apparatus may further comprise an annulus line forming an inlet to and an outlet from the main bore in a position of the bore below the tubing hanger latching profile for providing access to an annulus of a well. The apparatus may further comprise an annulus master valve, and the annulus line may extend radially from the main bore through a body of the apparatus to the annulus master valve. The annulus line may typically be arranged in a position between a tubing hanger latching profile and a casing hanger latching profile. In embodiments of the system having a plurality of casing hanger latching profiles, the annulus line may typically be an inlet to and an outlet from a portion of the main bore between the uppermost casing hanger latching profile and the tubing hanger latching profile.

The apparatus may further comprise a crossover line, for providing a crossover line from an annulus of a well to the flow line of the apparatus. The crossover line may comprise the annulus line. The crossover line may further comprise a crossover valve, for forming a barrier to the flow line.

Furthermore, the apparatus may comprise an external circulation line for accessing an annulus and/or the flow line. The external circulation line may be used as a bleed line for bleeding off pressure from an annulus, as an injection line for injecting a fluid into the annulus, as a circulation line for improving circulation in a well, and/or as a cementation line for a cementation task e.g. during a well abandonment phase. The external circulation line may have further uses.

The external circulation line may be arranged with connection means for connecting to a fluid flow means, such as a hose, pipe, tubing, or any other type of means through which fluid may securely flow. The fluid flow means may be connected to the external circulation line by use of an ROV. This allows for efficient access to the external circulation line by use of the fluid flow means and an ROV, for injecting fluid into or extracting fluid from the external circulation line. The connection means may be a hot-stab connection. The hot-stab connection may comprise a valve that may act as a barrier. The hot-stab connection may herein be referred to as an ROV valve stab receptacle.

The external circulation line may comprise a tubular structure having the above-mentioned connection means arranged in a first end portion of the tubular structure. A second end of the tubular structure of the external circulation line may connect to the crossover line. Thus, the circulation line may access, through the crossover line, both the annulus line and the flow line. The external circulation line may typically connect to the crossover line in a position in the crossover line between a crossover valve and an annulus master valve.

The external circulation line may further comprise a second valve for forming a barrier between the crossover line of the apparatus and the connection means of the external circulation line. The second valve may be any type of valve suitable for forming a barrier.

It may be said that the external circulation line comprises at least a portion of the crossover line and/or the annulus line, to form a complete line from the connection means of the external circulation line to the flow line and/or the bore of the apparatus below the production hanger latching profile.

In a conventional subsea system, a significant portion of a circulation line typically runs within a wall of a body of the Christmas tree and/or the high-pressure wellhead. As the wall typically offers little space, this conventional design limits the diameter of the circulation line. Except for radial penetration of the body of the apparatus, the external circulation line runs externally from any wall of the main body of the apparatus. The area where the external circulation line does penetrate the wall radially may be spacious. This means that the external circulation line of the apparatus may not have the same restrictions to its diameter as the circulation line of a conventional subsea system. This allows for a greater diameter of the external circulation line compared to that of a conventional circulation line. A greater diameter of the circulation line allows for greater fluid flow rates, which may be beneficial e.g. for well circulation jobs and for setting of cement plug during a well abandonment phase.

The external circulation line may form a line into the flow line and/or the main bore below the tubing hanger latching profile running separately from the crossover line and/or the annulus line. The external circulation line may comprise one or more valves for forming one or more barriers.

The apparatus may further comprise a radial bore through the body below a casing hanger latching profile for monitoring well parameters such as pressure and/or temperature. The bore may be arranged with a B annulus line for bleeding of pressure and/or for circulation.

The B annulus line may comprise a valve for providing a barrier. The B annulus line may comprise a plurality of valves. The B annulus line may be connected to the production line, to the crossover line and/or the external circulation line. The B annulus line may comprise one or more sensors, e.g. for monitoring pressure, temperature, flow rate or any other fluid characteristics that it may be beneficial to monitor. The B annulus line may be used e.g. for circulating drilling fluid, and/or for cementing during a well abandonment phase. The B annulus line may further comprise connection means for connecting to fluid flow means, such as a hot-stab connection. The fluid flow means may be any means through which fluid may flow, suitable for the purpose, such as a hose, a tubing and/or a pipe.

In an embodiment having more than one casing hanger latching profile, the apparatus may comprise further annulus lines, such as a C annulus line and/or a D annulus line, having one or more of the features of the B annulus line. The apparatus may typically have an annulus line above and below each casing hanger latching profile. In an example embodiment having a first and a second casing hanger latching profiles, and a tubing hanger latching profile, the apparatus may typically have the annulus line between the tubing hanger latching profile and the second casing hanger latching profile, the B annulus line between the second casing hanger latching profile and the first casing hanger latching profile, and the C annulus line below the first casing hanger latching profile.

The annulus lines may be greatly advantageous. Legislation is expected to be implemented as soon as reliable technology is available, requiring monitoring of the B-annulus. A direct access monitoring system, made possible by the B annulus line has the benefit that it may last for the life-time of a well, something which remote systems powered by batteries may not be able to offer. Furthermore, the annulus lines may offer a direct flow path to an annulus, which may allow for more efficient cementation techniques.

The apparatus may further comprise one or more chokes, one or more sensors, one or more cross-over valves, one or more of other types of valves, one or more flanges, one or more spools, and/or the apparatus may comprise other components that may increase the apparatus' functionality as a subsea drilling and production system or that may be beneficial for other reasons.

In some embodiments, the apparatus may comprise all the necessary components for the apparatus to fulfil all requirements of a subsea drilling and production system, and to fulfil partly or completely the functionality of a conventional subsea system, including that of the low-pressure well-head housing, the high-pressure wellhead housing, the production flow base and the Christmas tree. Furthermore, the apparatus may have functionality not typically offered by a conventional subsea system, such as some of the functionality offered by the B annulus line, the external circulation line and the interface spool. A great advantage of the apparatus may be that it can allow for on-shore assembly of a far greater portion of a complete subsea system than does prior art. Only drilling, installation of casings and tubings, completion, and manipulation of the system may be necessary to construct and operate the well. All of or a selection of the following may be assembled as the apparatus onshore: a flow control assembly, a protective structure, a suction caisson, a flow line, an external circulation line, a plurality of annulus lines, an ROV receptacle, latching profiles, and more.

The apparatus in some embodiments may thus allow for a simpler, more efficient installation and well development procedure than a conventional subsea system. In an embodiment, a suction caisson may offer a simpler foundation establishment, as it may require no drilling. The suction caisson may form the foundation of the well. Secondly, the step of installing a surface casing and a high-pressure wellhead housing may be skipped, as the functionality of the high-pressure wellhead housing may be fulfilled by the subsea system according to the invention. Skipping the step of establishing the 26 inches hole and 20 inches surface casing may limit the size of the well, though, and is thus mainly a good option for a relatively shallow well. Finally, the last step of installing the Christmas tree may also be skipped, as the functionality of the Christmas tree is covered by the apparatus.

The apparatus may further comprise a concentric tubing hanger, having a concentric shape. The concentric tubing hanger may comprise circumferential upper and lower tubing hanger seals. The concentric tubing hanger may further comprise an internal isolation valve and/or profiles for crown plug. Ports for the isolation valve may be drilled into a body of the concentric tubing hanger. The concentric shape may be advantageous over conventional casing hanger solutions, as a conventional hanger typically requires orientation means to be implemented to allow orientation of the tubing hanger during installation. The concentric tubing hanger does not require such orientation, and therefore does not require orientation means. By not requiring orientation means to be installed, the concentric tubing hanger solution can be advantageous as it may require less space in the main bore than a conventional tubing hanger solution.

The apparatus may comprise a casing and/or casing string. The apparatus may comprise a plurality of casings and/or casing strings. The apparatus may further comprise a production tubing, and/or it may comprise other forms of tubing. The apparatus may comprise an annulus between a casing and a tubing, an annulus between a casing and another casing, an annulus between a casing and a formation and/or an annulus between a tubing and a formation. The apparatus may comprise a partly or fully developed hydrocarbon well. The apparatus may comprise any downhole equipment in the well.

According to a ninth aspect of the invention there is provided a method for constructing a well, wherein the method comprises the step of: drilling a hole into a formation for a subsequent installation of a casing, wherein the drilling is performed through a bore in an apparatus according to the fifth aspect of the invention.

A method wherein a hole is drilled into a formation through a bore in an apparatus comprising a flow control assembly may be beneficial as the flow control assembly may be installed prior to the step of drilling the hole.

The method may further comprise the step of installing a casing into the hole in the formation through the bore of the apparatus. Furthermore, the method may comprise the step of cementing the casing in place in the hole in the formation, wherein the cementing operation is performed through the bore. The method comprising the steps of installing a casing through the bore and cementing the casing in place through the bore means a subsea system may comprise a flow control assembly prior to the installation of a casing, which means that a subsea system with an integrated flow control assembly may be assembled onshore.

The method may further comprise the step of installing a production tubing in a well, wherein the operation is performed through the bore of the apparatus.

The hole drilled through the bore of the apparatus may be for the installation of a casing with a diameter greater than the diameter of a production tubing to be installed subsequently during the well construction process. The hole may have a diameter large enough for the installation of the largest casing to be installed during the construction of the well.

The diameter of the hole drilled through the bore may be at least 12.25 inches. The diameter of the hole drilled through the bore may be at least 15 inches. The diameter of the hole drilled through the bore may be at least 17.5 inches.

The method may further comprise the step of installing an apparatus comprising a flow control assembly on a seabed, wherein the bore through which the drilling is performed is a bore though the apparatus, and wherein the installation of the apparatus is performed prior to a step of drilling for a subsequent installation of a casing for the well. Installing the apparatus prior to drilling operations may be advantageous for reasons mentioned in the previous paragraph.

The step of installing the apparatus may comprise the step of establishing a foundation for a well. Thus, the foundation may be comprised by the apparatus, such as in the case where the apparatus comprises a suction caisson. This may be particularly advantageous when developing an oil field with multiple wells to be constructed, as it allows for a smaller vessel, such as an anchor-handling vessel, to perform the task of installing the foundations of the wells, as drilling may not be necessary during the establishment of the foundations. Alternatively, the foundation may be a conventional conductor, wherein the conductor is configured for receiving the apparatus and wherein the apparatus is configured for having the conductor as a foundation.

The method may further comprise the step of performing a cementing operation in a well, wherein the cementing operation is performed through the bore of the apparatus.

The step of performing a cementing operation in a well may comprise the step of releasing cement returns onto a seabed through an outlet for cement returns. The outlet for cement returns may be an outlet in an interface spool of the apparatus.

Furthermore, the method may comprise the step of inserting into the bore of the flow control assembly a bore protector for protecting the bore and other parts of the apparatus against wear and/or pollution from mud, sand, rocks, cement, and/or other unwanted objects.

The method can be advantageous particularly in that it may not require a Christmas tree to be installed after completing the drilling process.

Furthermore, the method can be advantageous as the method may not require assembly of components of the system on the seabed. This stands in contrast to a conventional method of assembling a subsea system. A conventional system typically requires the low-pressure wellhead housing to connect to the high-pressure wellhead housing, and the high-pressure wellhead housing to connect to the production flow base and the Christmas tree. These are all typically installed at different stages of the well development process for a conventional system. Having to assemble the low-pressure wellhead housing, the high-pressure wellhead housing, the production flow base and the Christmas tree of a conventional subsea system together with each other subsea can be inefficient, and may necessitate that the components are designed for such subsea assembly, with connection and interface means that may otherwise not be necessary in an apparatus assembled on-shore.

According to a tenth aspect of the invention, there is provided an interface spool for acting as an interface between a main body of an apparatus for performing at least one operation to construct a well subsea and a well foundation. The well foundation may be a suction caisson, or it may be any other suitable foundation, such as a conductor. The main functions of the interface spool is to mate the main body with the foundation, and to transfer structural loads onto the suction caisson. The apparatus may be the apparatus according to the first aspect of the invention presented herein. The apparatus may comprise both the main body and the well foundation.

More specifically, there is described an interface spool for acting as an interface between the main body of the apparatus and the foundation, wherein the interface spool comprises an outlet for cement returns for routing cement onto a seabed outside of the foundation for preventing cement returns from returning through the main body of the apparatus during cementation when the apparatus is installed subsea. Having an interface spool with such features decreases the risk of having cement returns pollute valves, latching profiles and other sensitive equipment in the apparatus. The interface spool solution thus eliminates potential problems related to performing a cementing operation through an apparatus comprising a flow control assembly. The interface spool may comprise a plurality of outlets for cement returns. It may comprise one, two, three, four, five, six, seven, eight, or more than eight outlets for cement returns.

The outlet for cement returns may be a pipe running from an annulus of a wellbore, through the foundation, to an opening towards a sea floor. The pipe may comprise a valve for blocking the outlet, for creating a barrier between the sea and the annulus. The pipe may comprise a plurality of valves for creating a plurality of barriers.

The interface spool may further comprise a casing latching system for latching a casing in place after installing it in a wellbore. This is advantageous as it prevents upward movement of a casing string.

The interface spool may comprise an interface spool extension. The interface spool extension may be a pipe having a first end arranged to a lower end of the interface spool. The pipe may extend from the lower end of the interface spool to a bottom end of a foundation, such as a suction caisson, and may be arranged via a structural support to an exterior portion of the foundation.

The apparatus of any of the aspects herein may further comprise the interface spool.

According to an eleventh aspect of the invention, there is provided a method for cementing a casing in place in a wellbore by substantially filling an annulus between the casing and a surrounding formation with cement, wherein the method comprises the steps of:

providing cement into the wellbore through the casing;

running cement from inside the casing to the annulus; and running return cement through an outlet for cement return onto a seabed, wherein the cement return is comprised by an interface spool, and the interface spool is comprised by a subsea system.

The subsea system may be the apparatus according to the first aspect of the invention.

The method may comprise the step of opening a valve to allow return cement to run from the annulus, through the outlet, to the seabed. The valve may be a valve in the outlet for cement return.

The method described above may be advantageous for use with an apparatus wherein a flow control assembly and/or other sensitive equipment is installed and/or integrated prior to performing a cementing operation. During cementing, return cement may, by use of this method, escape to the seabed prior to reaching sensitive equipment, such as valves, sensors or hanger profiles, thus limiting the risk of having the sensitive equipment polluted by the cement.

According to a twelfth aspect of the invention, there is provided an external circulation line for accessing an annulus and/or a flow line of an apparatus for performing at least one operation to construct a well subsea. The external circulation line may be used as a bleed line for bleeding off pressure from an annulus, as an injection line for injecting a fluid into the annulus, as a circulation line for improving circulation in a well, and/or as a cementation line for a cementation task in a well, e.g. during a well abandonment phase. The external circulation line may have further uses. The apparatus may be a subsea system. The subsea system may comprise a fully or partly developed hydrocarbon well.

The external circulation line may be arranged with connection means for connecting to a fluid flow means, such as a hose, pipe, tubing, or any other type of means through which fluid may securely flow. The fluid flow means may be connected to the external circulation line by use of an ROV. This allows for efficient access to the external circulation line by use of the fluid flow means and an ROV for injecting fluid into or extracting fluid from the external circulation line. The connection means may be a hot-stab connection. The hot-stab connection may comprise a valve that may act as a barrier. The hot-stab connection may be referred to as an ROV valve stab receptacle. The connection means may further be referred to as an ROV receptacle.

The external circulation line may comprise a tubular structure having the above-mentioned connection means arranged in a first end portion of the tubular structure. A second end of the tubular structure of the external circulation line may connect to another line of the apparatus, such as a crossover line, an annulus line, a flow line and/or a main bore. Thus, the circulation line may access, either directly or through other lines, both or either one of an annulus line and a flow line. The external circulation line may typically connect to a crossover line in a position in the crossover line between a crossover valve and an annulus master valve. The external circulation line may further comprise a second valve for forming a barrier between the crossover line of the apparatus and the connection means of the external circulation line. The second valve may be any type of valve suitable for forming a barrier. The external circulation line may connect to a flow line, either directly or indirectly, and to an annulus, either directly or indirectly.

The external circulation line may comprise at least a portion of a crossover line and/or an annulus line to form a complete line from the connection means of the external circulation line to the flow line and/or the bore of the apparatus below the production hanger latching profile.

In a conventional subsea system, a significant portion of a circulation line typically runs within a wall of a body of the Christmas tree and/or the high-pressure wellhead. As the wall typically offers little space, this conventional design limits the diameter of the circulation line. Except for radial penetration of a body of an apparatus, the external circulation line runs externally from any wall of the main body of the apparatus. The area where the external circulation line does penetrate the wall radially may be spacious. This means the external circulation line of the apparatus may not have the same restrictions to its diameter as the circulation line of a conventional subsea system. This allows for a greater diameter of the external circulation line compared to that of a conventional circulation line. A greater diameter of the circulation line allows for greater fluid flow rates, which may be beneficial e.g. for well circulation jobs and for setting of a cement plug during a well abandonment phase.

According to a thirteenth aspect of the invention, there is provided a method of setting a cement plug in a well, wherein the method comprises the step of injecting cement into the well through an external circulation line. The cement plug may be a well abandonment cement plug.

The apparatus according to any aspect of the invention herein may comprise said external circulation line. The apparatus may be for performing at least an operation to construct a well subsea.

According to an fourteenth aspect of the invention, there is provided a method of establishing a cement well abandonment plug, wherein the method comprises the step of providing cement into a wellbore through an external circulation line. Furthermore, the method of establishing the cement well abandonment plug may comprise the step of feeding cement into the annulus vent/injection through a hot stab connection. Further steps involved in the method for establishing the cement plug may be steps known to a skilled person.

According to a fifteenth aspect of the invention, there is provided a subsea drilling system for drilling exploration wells, wherein the drilling system comprises a foundation, an interface spool and a high-pressure mandrel arranged to form an interface between the subsea system and a drilling blowout preventer and/or a Christmas tree.

The interface spool may be the aforementioned interface spool. The foundation may be a suction caisson, or any other foundation suitable for the purpose.

The foundation may form a low-pressure system for carrying loads such as vertical loads, horizontal loads and torque, the interface spool forms an interface between the foundation and the mandrel, and the high-pressure mandrel forms a high-pressure system for enduring pressure loads and forms an interface for further parts to be connected to the subsea system.

The subsea drilling system for drilling exploration wells is advantageous compared to prior art, as it allows for assembly of the drilling system to be performed onshore, and for the subsea system to be installed on a seabed in one operation. A conventional subsea system comprising a foundation, a low-pressure wellhead and a high-pressure wellhead typically needs several installation steps to be performed, as has been previously discussed.

According to a sixteenth aspect of the invention, there is provided an apparatus for performing at least one operation to construct a well subsea comprising a B annulus line, wherein the B annulus line forms a flow path for monitoring fluid characteristics in an annulus of a subsea well. The B annulus line may comprise a bore through a wall of a body of the apparatus, below a casing hanger latching profile, for providing a flow path from an annulus on the outer side of a casing suspended from a casing hanger latched to the latching profile. The B annulus line may comprise a line of tubing for bleeding off pressure from the annulus and/or for circulation of fluid in the annulus. The B annulus line may comprise a valve for providing a barrier. The B annulus line may comprise a plurality of valves. The B annulus line may be connected to a production line, to a crossover line and/or a circulation line such as an external circulation line. The B annulus line may comprise one or more sensors, e.g. for monitoring pressure, temperature, flow rate or any other fluid characteristics that it may be beneficial to monitor. The B annulus line may be used for circulating drilling fluid and/or for cementing during a well abandonment phase, or for any other relevant tasks. The B annulus line may further comprise connection means for connecting to fluid flow means, such as a hot-stab connection. The fluid flow means may be any means through which fluid may flow, suitable for the purpose, such as a hose, a tubing and/or a pipe.

The apparatus may comprise further annulus lines, such as a C annulus line and/or a D annulus line, having one or more of the features of the B annulus line. The apparatus may typically be provided with an annulus line above and below each casing hanger latching profile. In an example embodiment having a first and a second casing hanger latching profiles, and a tubing hanger latching profile, the apparatus may typically have an annulus line between the tubing hanger latching profile and the second casing hanger latching profile, a B annulus line between the second casing hanger latching profile and the first casing hanger latching profile, and a C annulus line below the first casing hanger latching profile.

The annulus lines may be greatly advantageous. Legislation is expected to be implemented as soon as reliable technology is available, requiring monitoring of the B-annulus. A direct access monitoring system, made possible by the B annulus line can have the benefit that it may last for the lifetime of a well, something which remote systems powered by batteries may not be able to offer. Furthermore, the annulus lines may offer a direct flow path to an annulus, which may allow for more efficient cementation techniques.

Any of the aspects described herein, in the claims, or elsewhere, may include one or more further features as defined in relation to any other aspect of the invention described herein. The apparatus of any of the aspects of the invention may alternatively be termed a "unit" and vice versa. The further features of any of the "apparatus" of the eighth to sixteenth aspects of the invention may in further embodiments be further features of any "unit" of the first to seventh aspects of the invention.

BRIEF DESCRIPTION OF THE DRAWINGS

In the following there will be described, by way of example only, embodiments of the invention with reference to the accompanying drawings, in which.

DETAILED DESCRIPTION OF THE DRAWINGS

Figure 1:
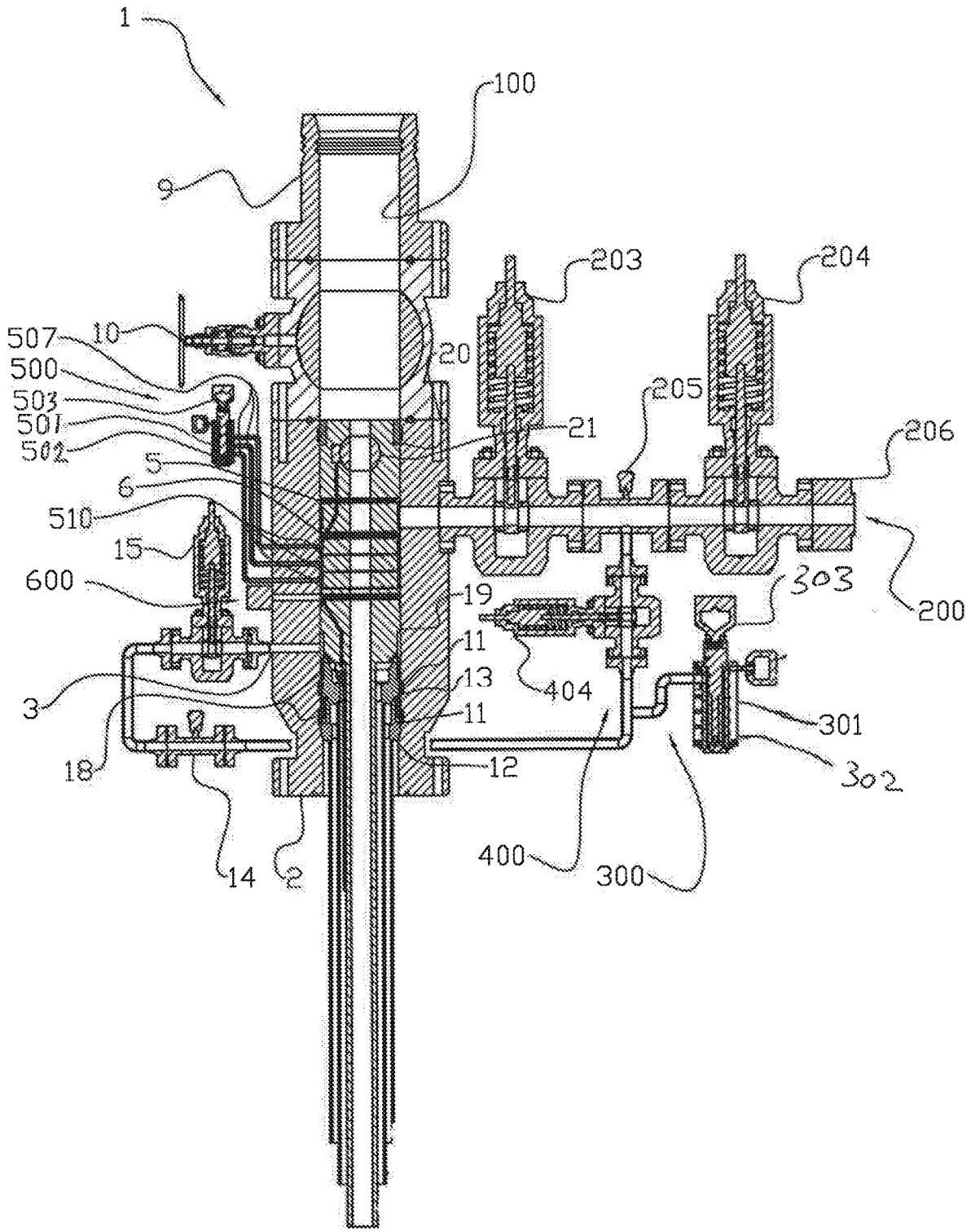
FIG. 1 illustrates an apparatus for performing at least one operation to construct a well subsea.

FIG. 1 illustrates an example apparatus 1 for performing at least one operation to construct a well subsea.

The apparatus 1 is arranged with a bore 100, a flow line 200, an external circulation line 300, and a crossover line 400. The flow line 200, the external circulation line 300 and the crossover line 400 all form flow paths from the bore 100.

The flow line 200 comprises a production master inner valve 203 and a production wing valve 204, which are both fail-safe valves. Furthermore, the flow line 200 comprises a production bore pressure and temperature sensor 205, enabling reading of pressure and temperature between the production master inner valve 203 and the production wing valve 204. The flow line further comprises a flow line connector 206, for connecting to an external flow line. The flow line 200 is connected to the main bore of the apparatus 1, such that a flow path is formed from the main bore 100 to and from the flow line 200.

The external circulation line 300 and the crossover line 400 shares a fail-safe annulus master valve 15 and an annulus bore pressure and temperature sensor 14, enabling reading of pressure and temperature in the lines 300, 400. The line shared by the external circulation line 300 and the crossover line 400 may be referred to as an annulus line. The annulus line comprises a bore 3 through a wall of a body 2 of the apparatus 1. Through the bore 3 through the body 2 of the apparatus 1, the annulus line connects to the main bore 100 of the apparatus 1. The crossover line 400 further comprises a crossover valve 404.

The external circulation line 300 comprises an ROV valve stab receptacle 301 comprising a male hot-stab receiver 303 and a female hot-stab receiver 302. As there may be a need for a double barrier between the end of the external circulation line 300 leading into the bore 100 and the end of the external circulation line 300 adapted to receive an ROV, this example comprises a not shown failsafe barrier valve comprised by the ROV valve stab receptacle 303.

The apparatus 1 in this example further comprises an mandrel 9 which may be an 18¾" mandrel with H4 profile, for forming an interface to a drilling BOP or a Cap connector or other equipment and a full-bore isolation valve 10 for isolating the main bore 100, Furthermore, the apparatus 1 comprises a control line system 500 comprising an ROV valve stab receptacle 501, a male hot-stab receiver 503 and a female hot-stab receiver 502, three control lines 507 and three tubing hanger down hole line seals 510 for sealing off down hole tubing hanger ports.

The apparatus 1 further comprises an inductive downhole line pressure sensor system 600, for reading pressure on downhole sensors. The system comprises means for inductive communication for sending power to and sending and/or receiving signals from a not shown downhole gauge system.

Furthermore, the apparatus comprises an upper tubing hanger seal 5 and a lower tubing hanger seal 6, providing a sealing system for sealing off the flow line 200.

The apparatus further comprises a concentric tubing hanger 19, for forming an interface between production outlet and production tubing, latching grooves 11 for enabling casing hanger latching rings to lock casings to the apparatus 1, an upper casing hanger 13 and a lower casing hanger 12, and two casing hanger seal and lock assemblies 18 for enabling hangers to be locked and sealed to the apparatus 1.

Figure 2:
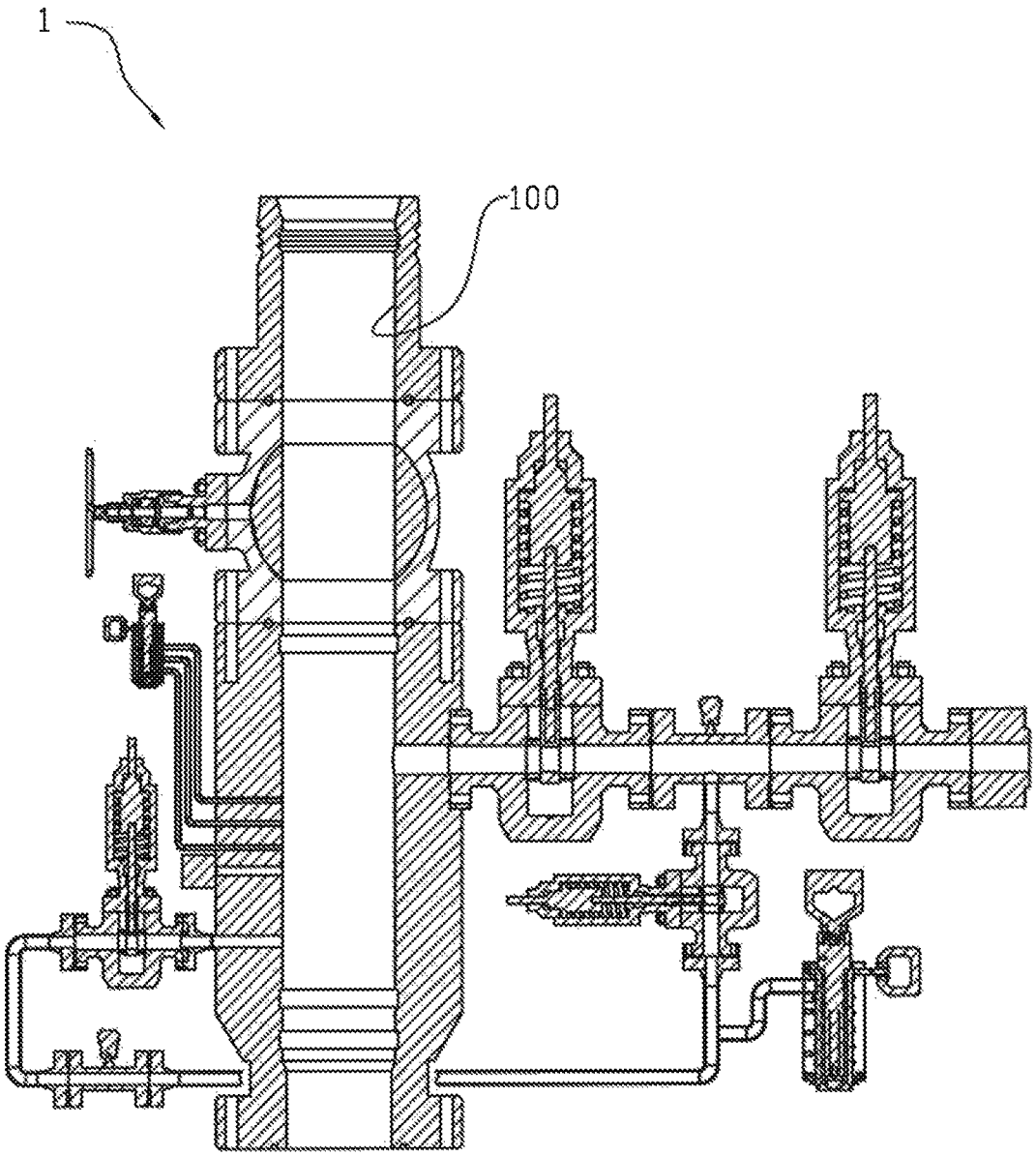
FIG. 2 shows a portion of the apparatus of FIG. 1, prior to insertion of a bore protector.
Figure 3:
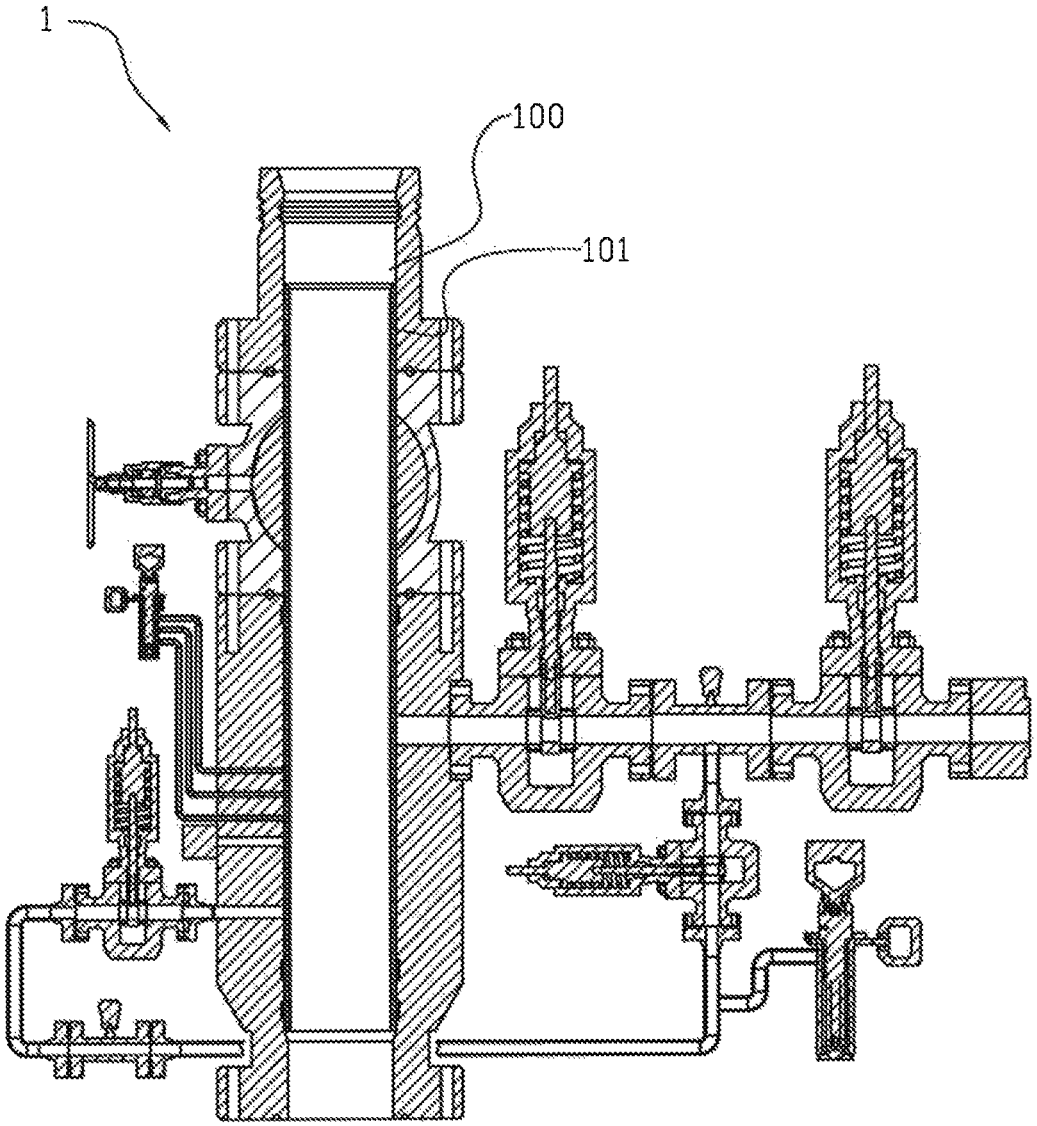
FIG. 3 shows the portion of the apparatus of FIG. 1 comprising the bore protector.
Figure 4:
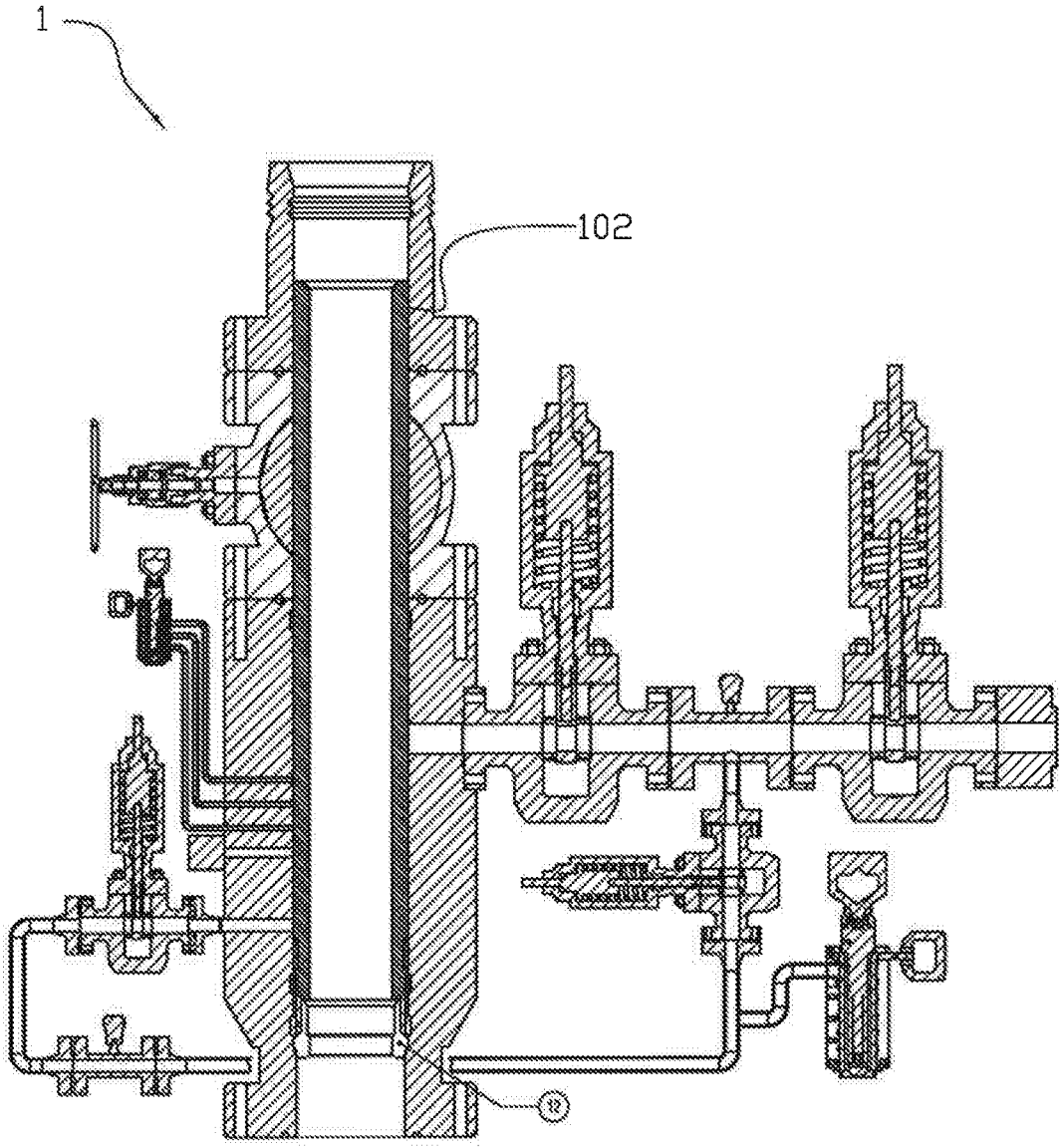
FIG. 4 shows the portion of the apparatus of FIG. 2 comprising a wear bushing.

FIG. 2 is included to show an example of the apparatus 1, prior to insertion of a bore protector into the bore 100. FIG. 3 shows the same example of the apparatus 1, wherein the apparatus 1 comprises the bore protector 101. The bore protector 101 may be inserted into the bore 100 to protect it and particularly sensitive equipment connected to the bore 100 from being polluted or otherwise damaged by drilling or cementing operations being performed through the bore 100. The bore protector 101 may be a wear bushing 102, as illustrated in FIG. 4. A wear bushing 102 is a type of bore protector 101 having a slightly smaller diameter than the bore protector 101. Wear bushings 102 are typically chosen to fit the size of drill bit to be used or casing or tubing to be installed through the bore 100.

Figure 5:
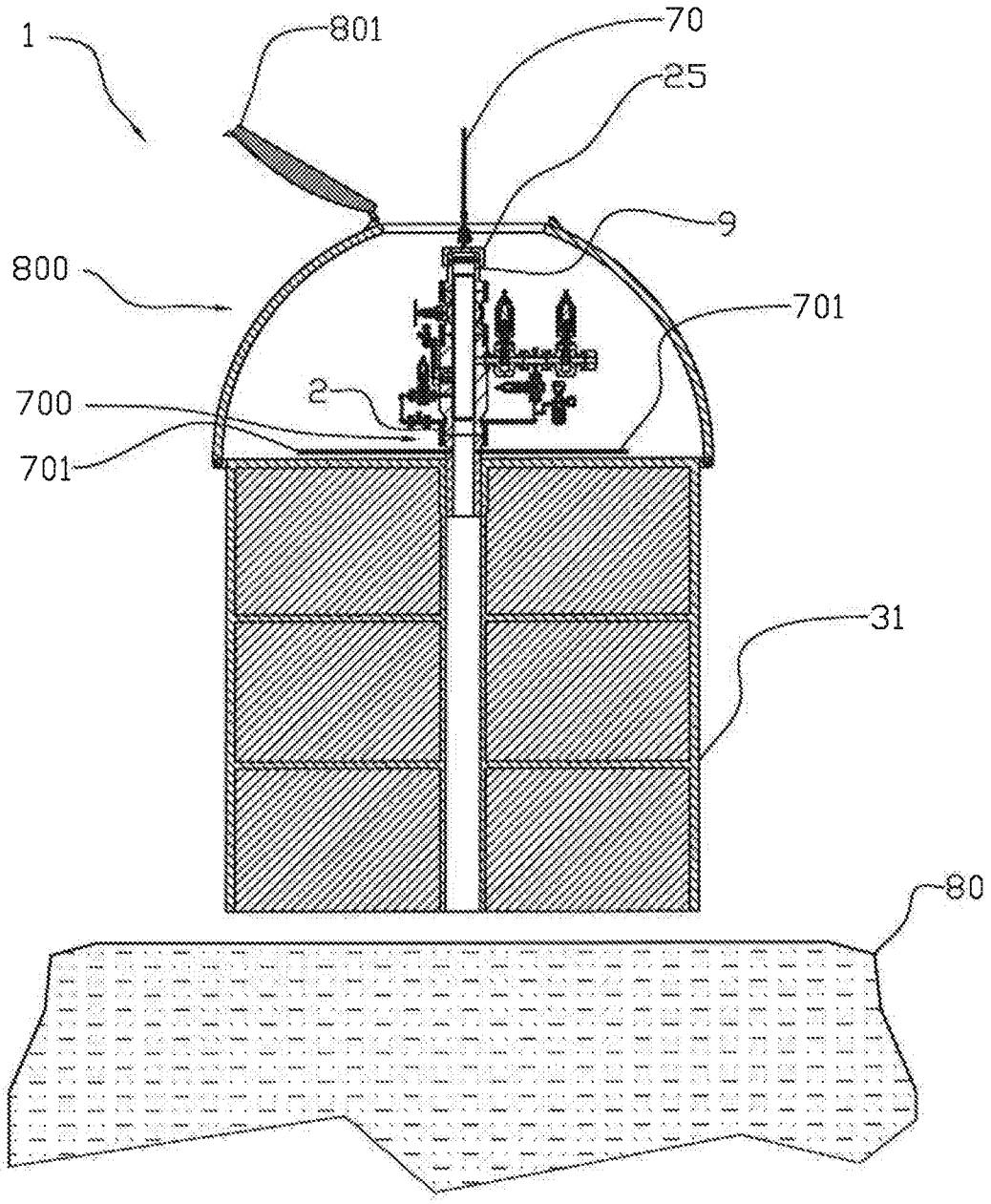
FIG. 5 shows the apparatus comprising a suction caisson, an interface spool and a protective structure, as the apparatus is lowered to a seabed.

FIG. 5 shows an example of the apparatus 1 comprising a suction caisson 31, an interface spool 700, a protective structure 800 and a lifting cap 25. The lifting cap 25 is fitted onto the 18¾" H4 mandrel with a H4 profile 9. FIG. 5 further shows a wireline 70 connected to the lifting cap 25, for lowering the apparatus 1 onto a seabed 80.

The protective structure 800 comprises a hatch 801 that can be open or closed. In the scenario illustrated in FIG. 5 it is open for allowing the wireline 70 to be connected to the lifting cap 25.

The interface spool 700 mates a main body 2 of the apparatus 1 to the suction caisson 31. The suction caisson 31 is arranged to form a foundation for the apparatus 1, and to carry structural loads such as vertical loads, horizontal loads and torque, and the interface spool 700 is arranged to transfer such loads from the main body 2 of the apparatus 1 to the suction caisson 31 foundation. The interface spool comprises two pipes forming two outlets 701 for cement returns for routing cement onto the seabed 80 during cementing operations. The outlets 701 allow cement returns to flow onto the seabed 80 instead of returning into the apparatus 1, which may be beneficial e.g. to avoid pollution of the bore and sensitive equipment comprised by the apparatus 1, such as valves and latches.

The protective structure 800 forms a protective shield for the apparatus against the subsea environment.

Figure 6:
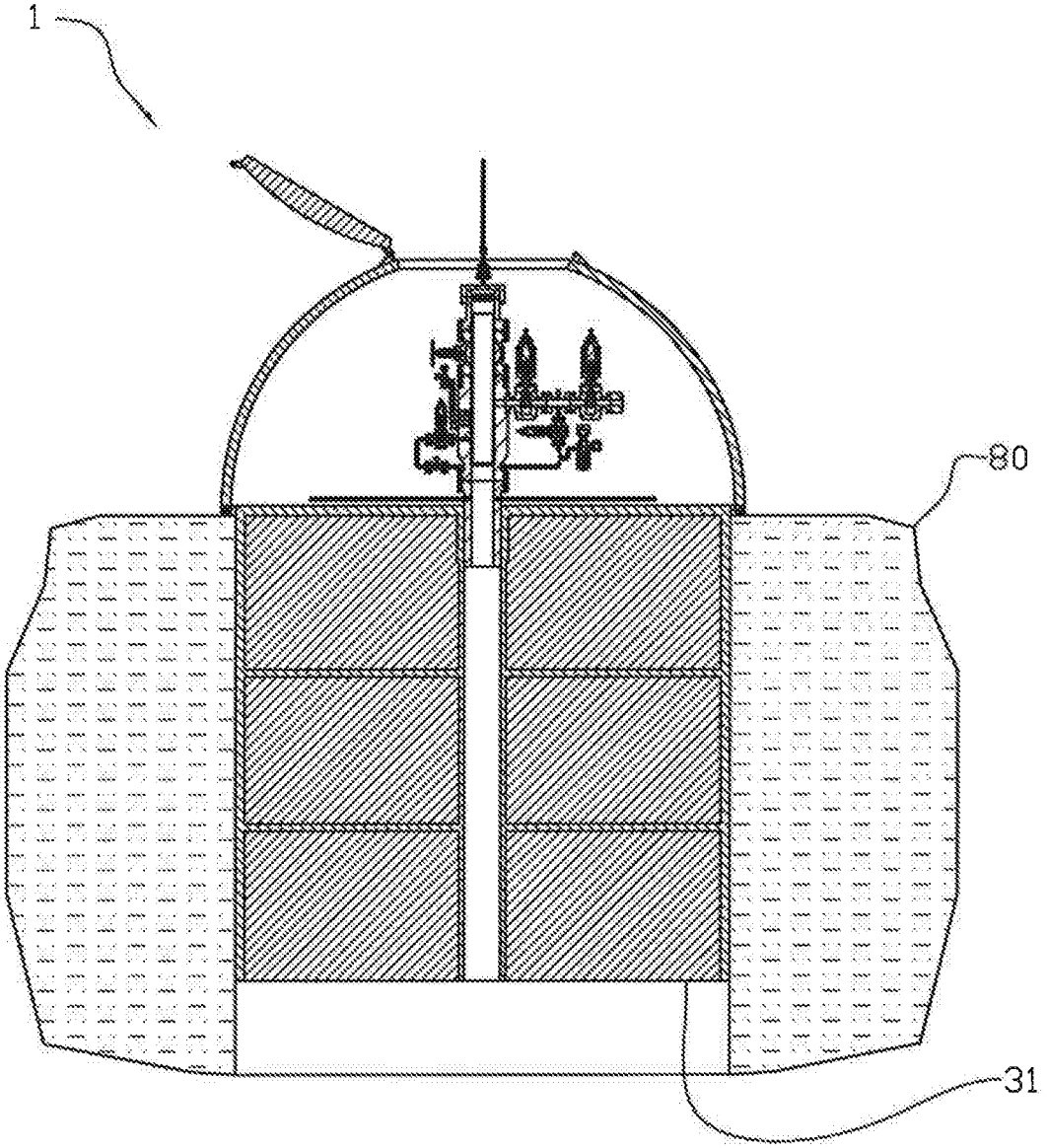
FIG. 6 shows the apparatus installed in a seabed, with the suction caisson forming a foundation.

FIG. 6 shows the apparatus 1 when installed in the seabed 80. The suction caisson 31 has sucked into the seabed 80 and created a foundation for the apparatus 1.

Figure 7:
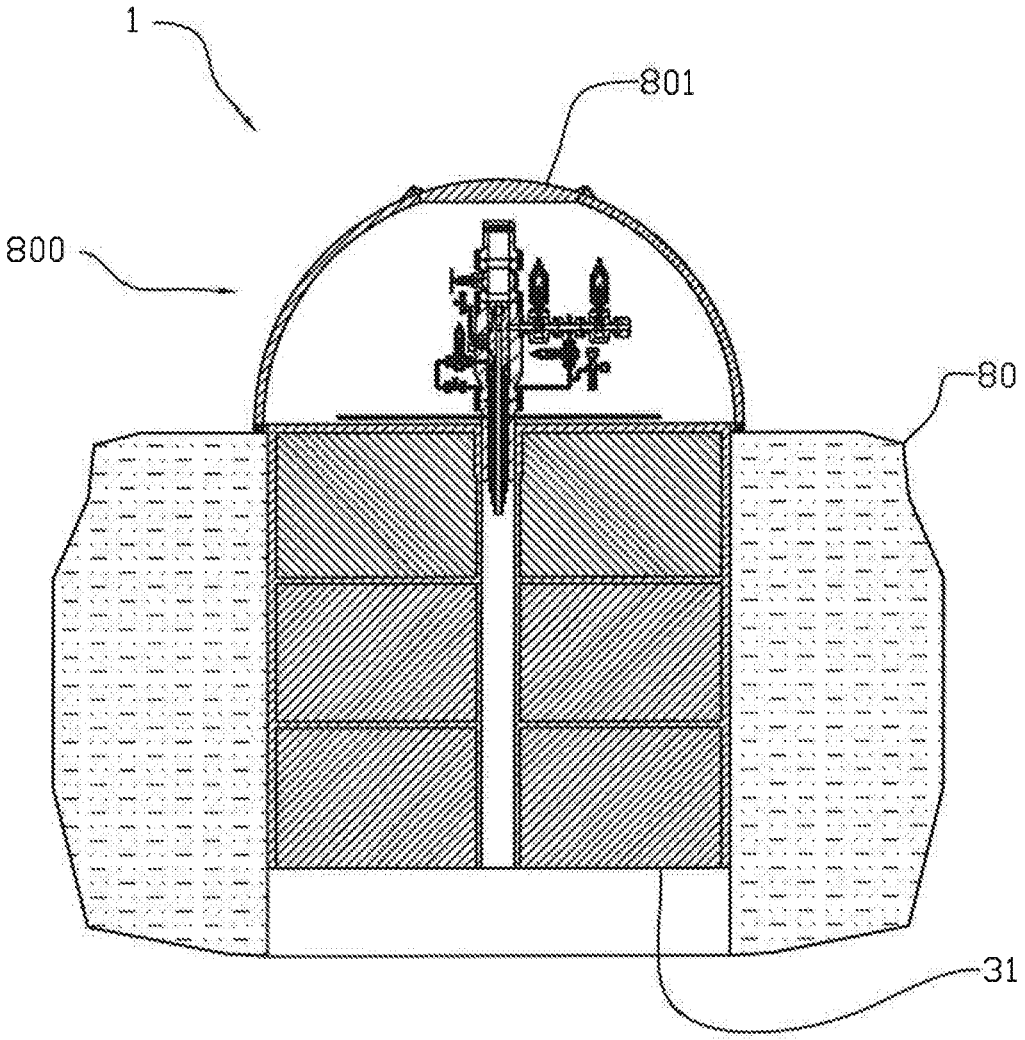
FIG. 7 shows the apparatus having been installed in the sea floor, with a hatch of the protective structure having been closed.

FIG. 7 shows an example of the apparatus 1 installed in the seabed 80, wherein the wireline has been disconnected from the apparatus and the hatch 801 of the protective structure 800 has been closed.

Figure 8:
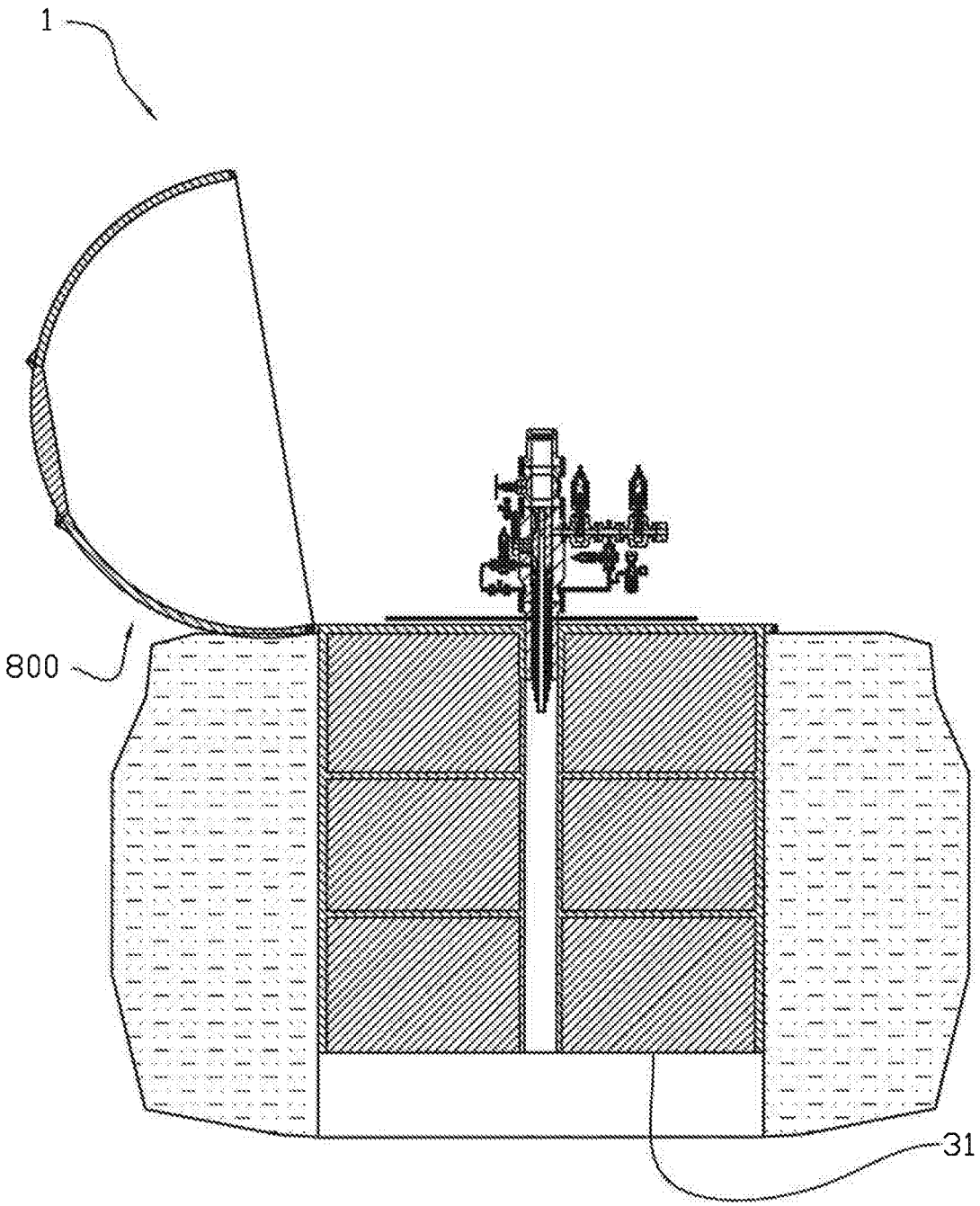
FIG. 8 shows the apparatus in place in the seabed, with the protective structure opened.

FIG. 8 illustrates the protective structure 800 that may be opened more completely than just by opening a hatch. The protective structure 800 is pivotally connected to the suction caisson 31, and may pivot so that it opens up for a more complete access to the apparatus 1 for external equipment, for maintenance, for manipulation of the system, or for other reasons.

Figure 9:
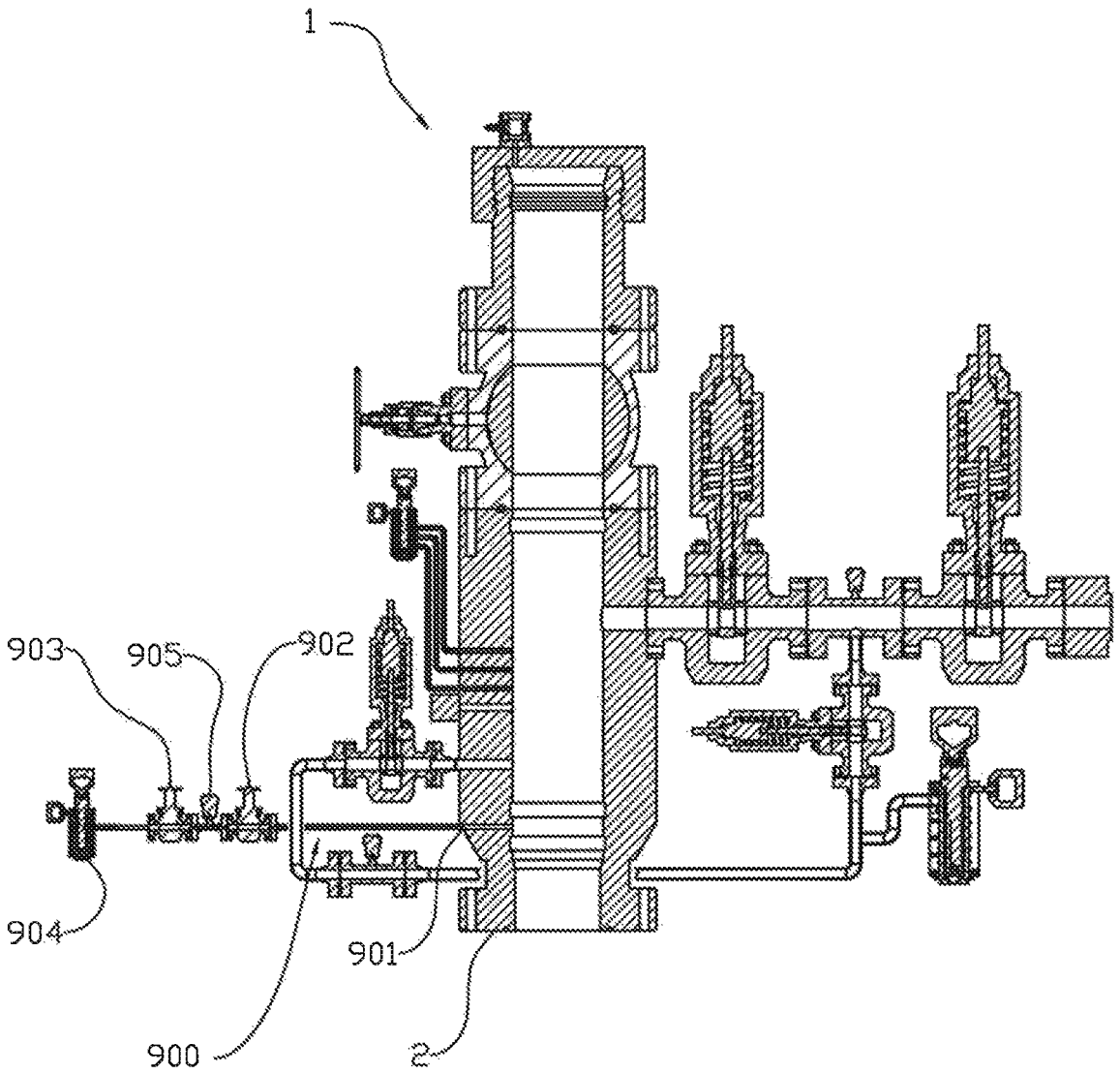
FIG. 9 shows the apparatus including a B annulus line.

FIG. 9 shows the apparatus 1 comprising a B annulus line 900 for monitoring fluid characteristics in and/or bleeding off pressure from and/or circulating fluid in and/or for injecting cement into an annulus in a well. The annulus line 900 comprises a bore 901 through a wall of a body 2 of the apparatus 1. Furthermore, the annulus line comprises a pressure and temperature sensor 905 between two valves 902, 903, and an ROV hot-stab receptacle 904.

Figure 10:
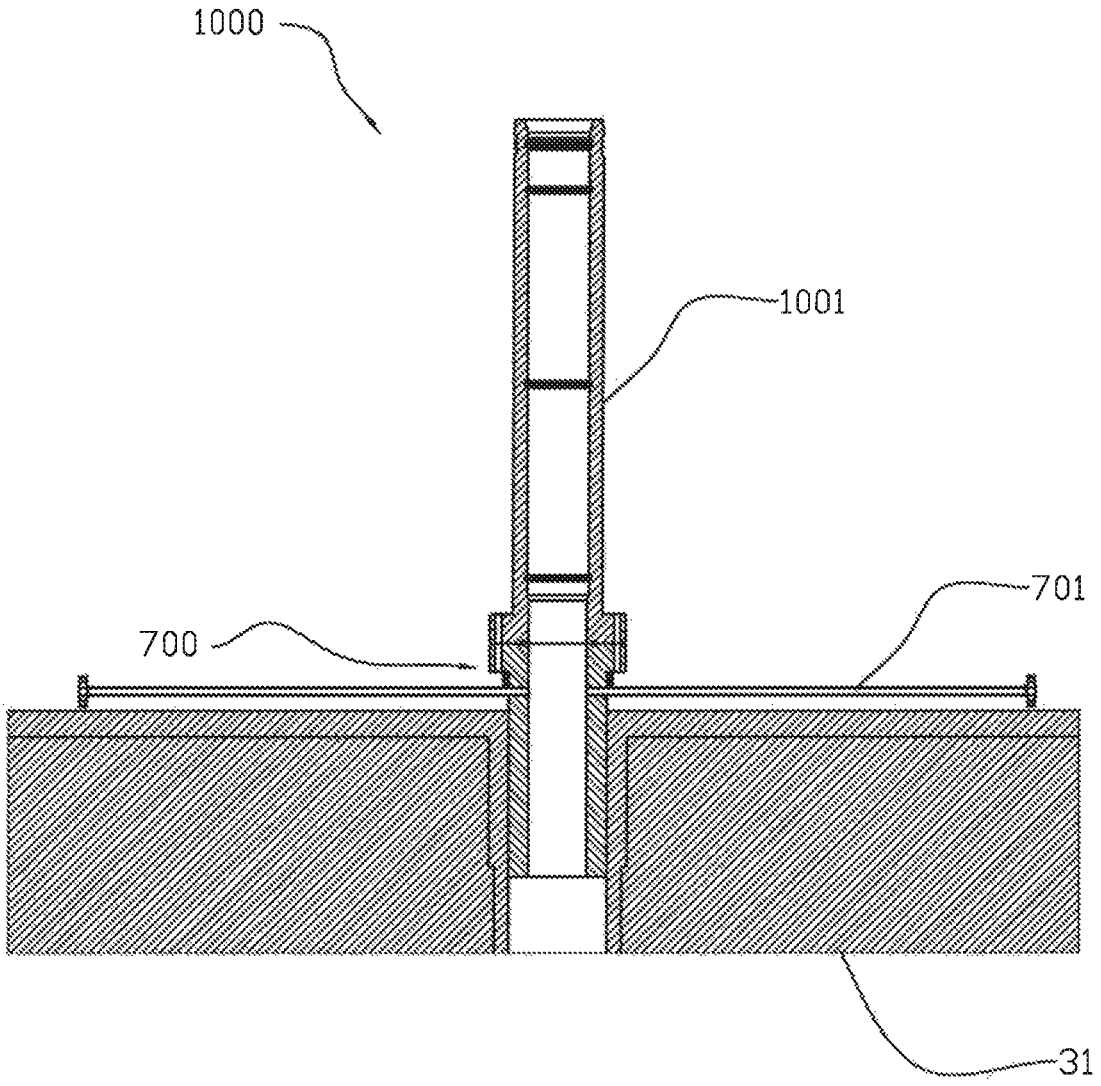
FIG. 10 shows a subsea drilling system for drilling exploration wells.

FIG. 10 shows a subsea drilling system 1000 for drilling exploration wells, wherein the drilling system comprises a suction caisson 31, an interface spool 700 and a high-pressure mandrel 1001 arranged to form an interface between the subsea system and a not shown drilling blowout preventer and/or a not shown Christmas tree. The interface spool 700 comprises cement outlets 701.

Figure 11:
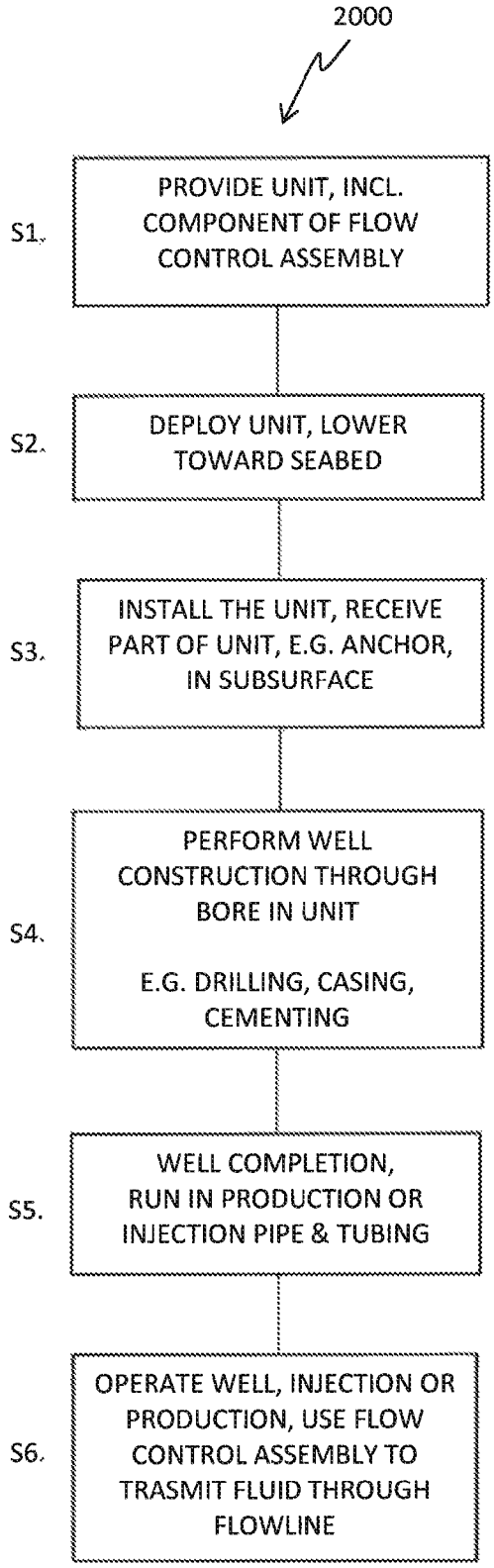
FIG. 11 is a flow diagram showing a method of constructing and operating a well according to an embodiment of the invention.

With reference to FIG. 11, steps of a method 2000 of constructing a subsea well are denoted S1 to S5.

At S1, a unit is provided by assembling parts as necessary. The unit has a component of a flow control assembly, e.g. a valve for controlling a flow of fluid in a flow line transmitting injection fluid or production fluid. Conveniently also, the unit has part such as a suction caisson or other member which is arranged to be inserted into the subsurface to anchor the unit in place.

At S2, once the unit is assembled and ready to be installed, it is deployed into the sea. The unit is lowered through the sea toward the seabed.

At S3, part of the unit, e.g. the suction caisson or other member that penetrates into the seabed, is received in the subsurface below the seabed and the unit is anchored in position. When anchored in position, part of the unit projects upward, and the component of the flow assembly is supported and located in the part projecting above the seabed. The anchoring may be facilitated by applying suction to the suction caisson and/or cementing the suction caisson or other member that penetrates the seabed in place.

Embodiments of the apparatus as exemplified in FIGS. 5 to 9 may constitute a unit of the kind referred to in relation to FIG. 11. The term "unit" here is used to indicate its unitary nature as a whole particuary in relation to the installation phase, in the sense that although it may have a collection of discrete or interconnected constituent parts, the unit is capable of being deployed, lowered and brought to the seabed in a single package or object that is to be anchored in place. Thus, the apparatus 1 of FIGS. 5 to 9, or any other apparatus of the various aspects of the invention described herein, may alternatively be termed a "unit" in this same sense.

This approach of providing and making use of the unit such as in the example of FIG. 11 or FIGS. 5 to 9 can advantageously allow components both for operation of the well in an injection or production phase of the well and for constructing the well to be installed simultanesously. This can provide benefits in time saving and process optimisation.

At S4, a well construction operation is performed through a bore in the unit once anchored. This operation can be for example running drill string through the bore and drilling a section of a wellbore of the well, running casing through the bore, hanging casing on a hanger profile in the bore, and cementing the casing in place by delivering cement through the bore in the unit. The operations may be repeated section-by-section to advance the borehole into the subsurface and line a wall of the wellbore.

At S5, the well is completed e.g. once the wellbore has been drilled and cased to the desired depth. The completion includes running in production or injection pipe into a target section of the wellbore. Furthermore, production or injection tubing is run in through the bore in the unit into the wellbore. The tubing is hung from a tubing hanger profile in the bore, e.g. in a tubular body of the unit. The tubing fluidly connects with the flow line of the flow control assembly through the aperture in the wall of the tubular main body of the unit in the part of the unit which projects above the seabed.

At S6, once the well has been constructed and completed, the well is operated. In order to do so, a wear bushing or other removable sheath may be removed from the bore in the unit to allow communication through a wall of the bore of the unit with a flow line for transmitting injection fluid or production fluid, depending on whether the well is a production well or an injection well. Various valves in the unit may be operated to configure a flow path connecting the flow line with the tubing wellbore. The flow control assembly is used to control the flow in the flow line to operate the well. In the case of production, the tubing conveys production fluid toward surface and out of the wellbore for onward processing via the flow line. In the case of the well being an injection well, the tubing conveys injection fluid from the flow line downhole into the well where it is injected into the formation.

In order to provide the unit in step S1, various parts may be assembled together to form the unit, typically onshore, on a rig or platform above seasurface, or other convenient location. In particular, the assembly step includes connecting a first tubular bore section, e.g. that extending through the main body, and a second tubular bore section end-to-end to obtain the bore in the unit through which the well construction operation is to be performed. By way of the connection the first tubular bore section may be connected to the part of the unit, e.g. the suction caisson or other member, which is to be received in the subsurface to anchor the unit in place. The end to end connection may be formed by making up a flanged joint between the sections.

Note that the drawings are shown highly simplified and schematic and the various features therein are not necessarily drawn to scale. Identical reference numerals refer to identical or similar features in the drawings.

It should further be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The mere fact that certain measures are recited in mutually different dependent claims does not indicate that a combination of these measures cannot be used to advantage.

Although certain parts of the description above refers to a production well and a flow line for transmitting hydrocarbon production fluid away from wellbore, in other variants the constructed well may be an injection well and the flow assembly may be used to control the flow of injection fluid into the wellbore through the flow line. Features referring to "production" may therefore in the case of an injection well be taken to be referring to "injection".

The invention claimed is:

1. A method of constructing a subsea well, the method comprising the steps of:

providing a unit comprising:

at least one component of a flow control assembly, the flow control assembly to be operable for controlling a flow of injection or production fluid during operation of the well after the well has been constructed;

a suction caisson or anchor; and end-to-end connected first and second tubular bodies, the first tubular body having an aperture in a wall for transmitting the injection or production fluid between a flow line section and an inside of the first tubular body during operation of the well after the well has been constructed, and the first tubular body further having at least one casing or liner hanger profile for hanging casing or liner from the first tubular body, the second tubular body being connected to the suction caisson or anchor;

lowering the unit through sea toward a seabed;

receiving the suction caisson or anchor in a subsurface of the seabed to anchor the unit in place, part of the unit projecting above the seabed, whereby said component of the flow control assembly is positioned in the projecting part; and performing at least one well construction operation through a bore in the unit.

2. The method as claimed in claim 1, wherein providing the unit includes flange-to-flange connecting between the first and second tubular bodies.

3. The method as claimed in claim 1, wherein the second tubular body comprises at least one of a spool body and spool body extension which extends vertically from an upper end of the suction caisson or anchor upon anchoring the unit in place.

4. The method as claimed in claim 1, wherein the component of the flow control assembly comprises the flow line section for transmitting production or injection fluid away from or into a wellbore of the well.

5. The method as claimed in claim 1, wherein the component of the flow control assembly comprises at least one valve or part thereof.

6. The method as claimed in claim 1, wherein the component of the flow control assembly comprises a master inner valve and a master outer valve disposed on the flow line section, the flow line section extending radially outwardly from an exterior of the first tubular body.

7. The method as claimed in claim 1, wherein the component of the flow control assembly comprises at least one of: a choke valve; a crossover valve; a crossover line; an external circulation line; and an annulus master valve.

8. The method as claimed in claim 1, wherein the component of the flow control assembly includes the flow line section, and the flow line section includes a temperature sensor or a pressure sensor.

9. The method as claimed in claim 1, wherein the bore through which the well construction is to be performed is a first, main bore and the first tubular body further includes a second bore through the wall of the first tubular body for obtaining communication with an annulus in a wellbore of the subsea well.

10. The method as claimed in claim 1, which further comprises connecting the following to the unit:

at least one isolation valve to selectively open or close the bore above the first tubular body or above the aperture; and a mandrel to be positioned above the isolation valve for connecting a blowout preventer or a riser to an upper end of the mandrel.

11. The method as claimed in claim 10, wherein the mandrel is an 18¾ inch mandrel.

12. The method as claimed in claim 1, which further comprises anchoring the unit in place by securing the suction caisson or anchor received in the subsurface by applying suction.

13. The method as claimed in claim 1, wherein the step of performing the well construction operation comprises:

running at least one casing or liner through the bore in the unit; and hanging the casing or liner from the casing or liner hanger profile.

14. The method as claimed in claim 1, wherein the first tubular body of the unit further comprises at least one tubing hanger profile, and the method further comprises:

running at least one tubing through the bore in the unit; and hanging the tubing from the tubing hanger profile.

15. The method as claimed in claim 1, wherein performing the well construction operation comprises running a drill string through the bore in the unit and drilling a section of a wellbore of the well using the drill string.

16. The method as claimed in claim 15, wherein the drilling is performed to drill a hole in the subsurface with a diameter of 17.5 inches or more.

17. The method as claimed in claim 1, wherein performing the well construction operation comprises running a section of casing or liner into the subsurface through the bore in the unit.

18. The method as claimed in claim 16, which further comprises cementing the section of casing or liner by delivering cement or curable mass into the subsurface through the bore in the unit.

19. The method as claimed in claim 1, wherein the unit further comprises a tubular protector or wear bushing which is removably inserted to line the bore in the unit, and the method further comprises removing the protector or wear bushing to allow the flow control assembly to be operated in the production or injection phase of the constructed well.

20. A unit for constructing and operating a subsea well, the unit comprising:

at least one component of a flow control assembly, the flow control assembly to be operable for controlling a flow of injection or production fluid in a flow line during operation of the well after the well has been constructed;

at least one part configured to be received in a subsurface of the seabed for anchoring the unit in place, comprising a suction caisson or anchor;

a stack of assembled parts comprising end-to-end connected first and second tubular bodies, the first tubular body comprising a tubular main body having an aperture in a wall of the body for transmitting injection or production fluid between a flow line of the flow control assembly and an inside of the main body, and at least one casing or liner hanger profile for hanging casing or liner, the second body being connected to the suction caisson or anchor; and a bore through which at least one well construction operation can be performed, the bore extending through the stack;

wherein the unit is configured so that it can be lowered in a single package toward the seabed and anchored in place through receiving said part of the unit in the subsurface.

21. The unit as claimed in claim 20, wherein the stack of assembled parts includes at least one of:

a wear bushing located inside the bore to line the bore;

at least one isolation valve to selectively open or close the bore above the main body or above the aperature; and a mandrel to be positioned above the isolation valve for connecting a blow out preventer or a riser to an upper end of the connector mandrel.

22. The unit as claimed in claim 21, wherein the second tubular body comprises a tubular interface spool.

23. The unit as claimed in claim 21, which includes a flange-to-flange connection between the first and second tubular bodies.

24. The unit as claimed in claim 21, wherein the component of the flow control assembly comprises a flow line section, a master inner valve, and a master outer valve disposed on the flow line section, the flow line section extending radially outwardly from an exterior of the first tubular body.

25. A method of providing a unit to be deployed for constructing and operating a subsea well, the unit comprising:

at least one component of a flow control assembly, the flow control assembly to be operable for controlling a flow of injection or production fluid in a flow line during operation of the well after the well has been constructed;

at least one part configured to be received in a subsurface of the seabed for anchoring the unit in place, comprising a suction caisson or anchor;

a stack of assembled parts comprising end-to-end connected first and second tubular bodies, the first tubular body comprising a tubular main body having an aperture in a wall of the body for transmitting injection or production fluid between a flow line of the flow control assembly and an inside of the main body, and at least one casing or liner hanger profile for hanging casing or liner, the second body being connected to the suction caisson or anchor; and a bore through which at least one well construction operation can be performed, the bore extending through the stack;

wherein the unit is configured so that it can be lowered in a single package toward the seabed and anchored in place through receiving said part of the unit in the subsurface;

the method comprising: prior to deployment, assembling parts together to form the unit.

26. A method of constructing a subsea well, the method comprising:

running a section of casing into the subsurface through a bore in a subsea unit for constructing and operating a subsea well, the unit comprising:

at least one component of a flow control assembly, the flow control assembly to be operable for controlling a flow of injection or production fluid in a flow line during operation of the well after the well has been constructed;

at least one part configured to be received in a subsurface of the seabed for anchoring the unit in place, comprising a suction caisson or anchor;

a stack of assembled parts comprising end-to-end connected first and second tubular bodies, the first tubular body comprising a tubular main body having an aperture in a wall of the body for transmitting injection or production fluid between a flow line of the flow control assembly and an inside of the main body, and at least one casing or liner hanger profile for hanging casing or liner, the second body being connected to the suction caisson or anchor; and a bore through which at least one well construction operation can be performed, the bore extending through the stack;

wherein the unit is configured so that it can be lowered in a single package toward the seabed and anchored in place through receiving said part of the unit in the subsurface; and the flow control assembly to be operable for controlling a flow of injection or production fluid in a flow line during operation of the well after the well has been constructed.

27. A method as claimed in claim 26, which further comprises running a drill string through the bore and drilling at least one section of a wellbore of the well using the drill string.

* * * * *